US009653052B2

(12) United States Patent
Bedson

(10) Patent No.: US 9,653,052 B2
(45) Date of Patent: May 16, 2017

(54) DRUMHEAD TUNING RIM SYSTEM AND METHOD OF USE

(71) Applicant: Bedson Drum Co., Seattle, WA (US)

(72) Inventor: Bryan Thomas Bedson, Costa Mesa, CA (US)

(73) Assignee: Bedson Drum Co., Seattle, WA (US)

( * ) Notice: Subject to any disclaimer, the term of this patent is extended or adjusted under 35 U.S.C. 154(b) by 128 days.

(21) Appl. No.: 14/576,186

(22) Filed: Dec. 18, 2014

(65) Prior Publication Data

US 2015/0107440 A1 Apr. 23, 2015

Related U.S. Application Data

(63) Continuation-in-part of application No. 14/383,510, filed as application No. PCT/US2014/010532 on Jan. 7, 2014, now Pat. No. 9,006,548, which is a continuation of application No. 13/740,148, filed on Jan. 11, 2013, now Pat. No. 8,642,867.

(51) Int. Cl.
*G10D 13/02* (2006.01)

(52) U.S. Cl.
CPC ..... *G10D 13/023* (2013.01); *Y10T 29/49574* (2015.01)

(58) Field of Classification Search
CPC .... G10D 13/023; G10D 13/02; G10D 13/021; G10D 13/027; G10D 13/026; G10D 13/04; G10G 5/00
USPC ..... 84/411 R, 413
See application file for complete search history.

(56) References Cited

U.S. PATENT DOCUMENTS

| | | | |
|---|---|---|---|
| 19,602 | A | 3/1858 | Zimmerman |
| 223,586 | A | 1/1880 | Fayaux |
| 795,034 | A | 7/1905 | Harris |
| 2,173,443 | A | 9/1939 | Schuman |
| 2,495,450 | A | 1/1950 | Gladstone |
| 3,215,019 | A | 11/1965 | Sloan |
| 4,312,259 | A | 1/1982 | Henrit |
| 5,934,599 | A | 8/1999 | Hammerslag |

(Continued)

FOREIGN PATENT DOCUMENTS

| | | | |
|---|---|---|---|
| AT | 388463 | B | 11/1988 |
| CH | 274881 | A | 4/1951 |

OTHER PUBLICATIONS

International Search Report and the Written Opinion of the International Searching Authority PCT/US2014/010532 Aug. 22, 2014.

(Continued)

*Primary Examiner* — Kimberly Lockett
(74) *Attorney, Agent, or Firm* — Lodestone Legal Group; Jeromye V. Sartain

(57) ABSTRACT

A drumhead tuning rim system and method for securing and tuning a drumhead on a drum shell of a drum, comprising a drumhead tuning rim apparatus comprising a cable tension dial assembly configured for operably engaging a rim of the drum so as to increase or decrease tension on the rim, the rim being configured for seating over the drumhead on the drum shell, and an apparatus controller configured for operably interfacing with the drumhead tuning rim apparatus so as to selectively control the cable tension dial assembly and thereby adjust the overall pitch of the drumhead as by adjusting the tension on the rim.

29 Claims, 8 Drawing Sheets

(56) References Cited

U.S. PATENT DOCUMENTS

| | | | | |
|---|---|---|---|---|
| 6,040,513 | A * | 3/2000 | Belli | G10D 13/021 84/411 R |
| 6,202,953 | B1 | 3/2001 | Hammerslag | |
| 6,289,558 | B1 | 9/2001 | Hammerslag | |
| 6,410,833 | B1 | 6/2002 | Brando | |
| 6,441,286 | B1 | 8/2002 | Brando | |
| 6,667,432 | B2 | 12/2003 | Brando | |
| 6,812,392 | B2 | 11/2004 | Brando | |
| 7,045,696 | B2 | 5/2006 | Henry | |
| 7,591,050 | B2 | 9/2009 | Hammerslag | |
| 7,888,575 | B1 | 2/2011 | Toscano | |
| 8,091,182 | B2 | 1/2012 | Hammerslag et al. | |
| 8,424,168 | B2 | 4/2013 | Soderberg et al. | |
| 9,349,355 | B2 | 5/2016 | Jones | |
| 2004/0159209 | A1* | 8/2004 | Henry | G10D 13/023 84/419 |
| 2012/0246974 | A1 | 10/2012 | Hammerslag et al. | |

OTHER PUBLICATIONS

Drum Tech "DTS—Drum Tuning System" web page content obtained Jan. 25, 2017 from http://www.drumtech.com/dts-drum-tuning-system.

Drum Tech "DTS 'One-Touch Drum Tuning System'" YouTube video landing page content obtained Jan. 25, 2017 from https://www.youtube.com/watch?v=JYxBNrq8ldc.

* cited by examiner

DRUMHEAD TUNING RIM SYSTEM AND METHOD OF USE

RELATED APPLICATIONS

This is a continuation-in-part application of a prior filed and currently pending U.S. application Ser. No. 14/383,510 and filing date of Sep. 5, 2014, which is itself a U.S. national stage entry from international PCT patent application number PCT/US2014/010532 filed Jan. 7, 2014, itself claiming priority to a prior U.S. application Ser. No. 13/740,148 and filing date of Jan. 11, 2013, which is now U.S. Pat. No. 8,642,867 issued on Feb. 4, 2014, each entitled "Drumhead Tuning Rim Apparatus and Method of Use," the contents of all of which are incorporated in their entireties herein by reference.

INCORPORATION BY REFERENCE

Applicant hereby incorporates herein by reference any and all patents and published patent applications cited or referred to in this application.

BACKGROUND OF THE INVENTION

Field of the Invention

Aspects of this invention relate generally to musical drums, and more particularly to devices for holding and tuning a drumhead on a drum shell and systems incorporating such devices.

Description of Related Art

As is known in the art, musical instruments generally referred to as "drums" are typically comprised of a drum shell and one or more drumheads. The drum shell is usually a hollow annular body of wood or other material having a certain diameter and length or depth. A drumhead is essentially a membrane, traditionally of animal skin and now more often of synthetic fiber such as polyester, Mylar, Kevlar or other suitable material, that is stretched over one or both open ends of the drum shell so as to vibrate and produce a tone when struck by the hand, a drum stick, or other object. Each drumhead is typically formed with a relatively rigid hoop about its perimeter, which is configured to seat on or about an open end of the drum shell. The drumhead may thus be held in place and in tension on the drum shell by affixing it thereto, either with bolts through metal "claws" attached directly to the hoop of the drumhead or with bolts through holes in a flanged rim that fits over the drumhead hoop and effectively pinches or traps the drumhead hoop between the rim and the drum shell. The bolts, called tension rods, are screwed, as with a drum key, into threaded lugs attached to the drum shell in order to secure and tune the drumhead. Depending on the size and style of the drum, ranging from large bass drums to small toms and the classic snare drum, the drum shell and corresponding rim(s) may be configured with six, eight, or twelve tension rod and lug sets or pairs.

The challenge with the prior art system of securing and tuning a drumhead through the conventional tension rod and lug hardware that has been employed for decades is that producing uniform tension all the way around the drumhead hoop or rim as by individually adjusting each tension rod, and thus evenly tuning the drumhead across its entire surface, is difficult and time-consuming. What is needed and has heretofore been unavailable is a more convenient and effective drumhead tuning rim system and method. Aspects of the present invention fulfill these needs and provide further related advantages as described in the following summary.

SUMMARY OF THE INVENTION

Aspects of the present invention teach certain benefits in construction and use which give rise to the exemplary advantages described below.

Aspects of the present invention are directed to a drumhead tuning rim system for securing and tuning a drumhead on a drum shell of a drum, comprising a drumhead tuning rim apparatus comprising a cable tension dial assembly configured for operably engaging a rim of the drum so as to increase or decrease tension on the rim, the rim being configured for seating over the drumhead on the drum shell, and an apparatus controller configured for operably interfacing with the drumhead tuning rim apparatus so as to selectively control the cable tension dial assembly and thereby adjust the overall pitch of the drumhead as by adjusting the tension on the rim.

A primary objective inherent in the above-described system and method of use is to provide advantages not taught by the prior art.

Another objective is to provide such a system and method that enables uniform tuning of a drumhead through interaction with an apparatus controller rather than the multiple tension rods in prior art drumhead hardware configurations.

A still further objective is to provide such a system and method that enables removal or installation of a drumhead through interaction with an apparatus controller and associated loosening or tightening of a single cable rather than threadably disengaging or engaging the multiple tension rods in prior art drumhead hardware configurations.

A still further objective is to provide such a system and method that enables electronic tuning of an otherwise conventional drum or drum kit.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above-described drawing figures illustrate aspects of the invention in at least one of its exemplary embodiments, which are further defined in detail in the following description.

Figure 1:
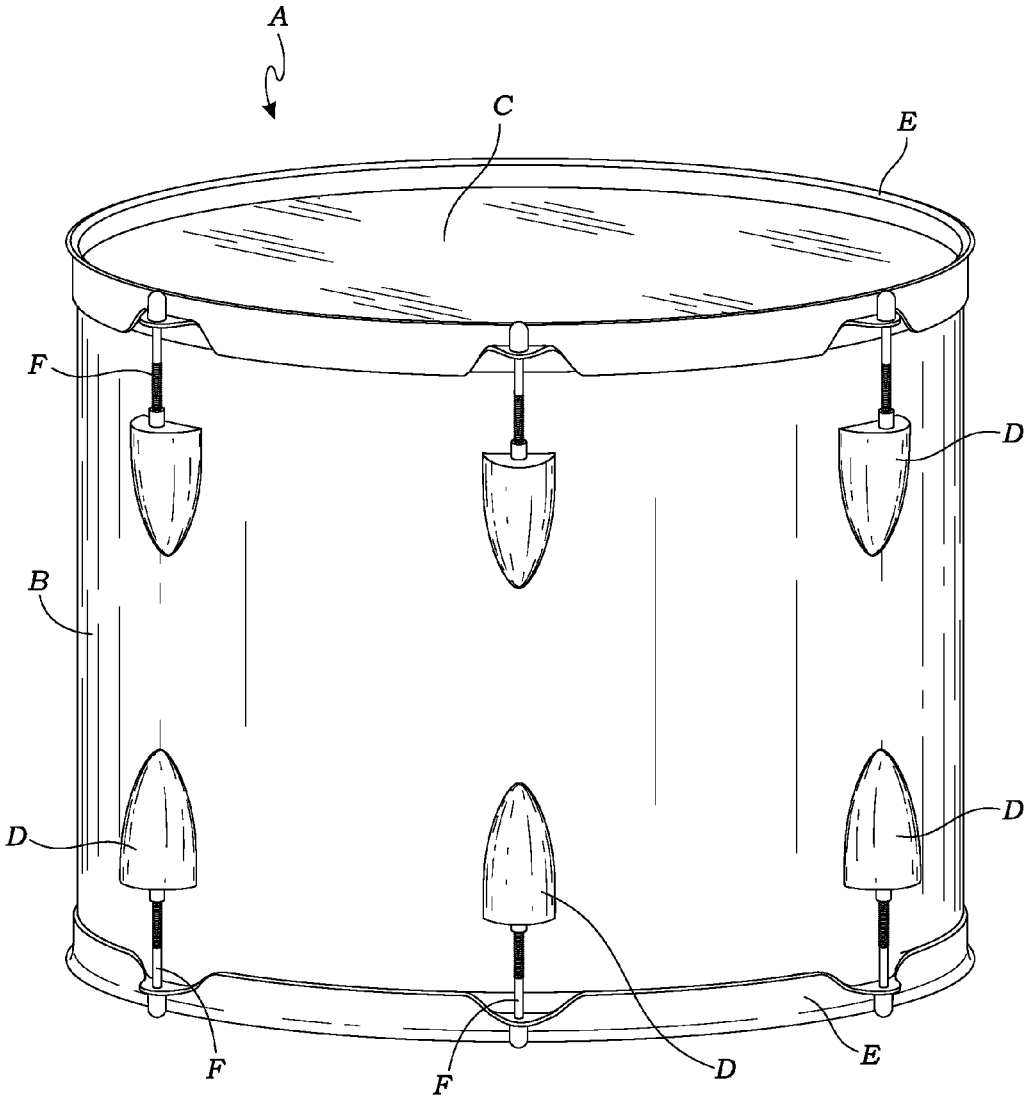
Prior Art Fig. 1
FIG. 1 is a perspective view of an exemplary prior art drum with drumhead mounting hardware.

By way of further background, and with initial reference to FIG. 1 depicting a typical tom-tom drum as is known and used in the art, the drum A is comprised of a drum shell B and one or more drumheads C stretched over one or both open ends of the drum shell B. The drum shell B is configured with lugs D spaced about its circumference, one row of lugs D for each of the top and bottom rims E. Each such rim E is configured to seat about a hoop or edge (not shown) of the drumhead C and so trap or retain the drumhead C about an open end of the drum shell B. The rim E is formed with a flange having through-holes into which are inserted bolts or tension rods F for threadable engagement with the respective lugs D. As such, the drumhead C is tuned in the prior art drum A by selectively tightening or loosening the tension rods F, whether by hand or using a drum key or other tool (not shown), so as to put the desired amount of tension or stretch on the portion of the drumhead C corresponding to the respective tension rod-lug pair. Depending on the size and style of the drum, there may be from six to twelve or more such pairs of tension rods and lugs that would need to be individually adjusted in an effort to create uniform tension over the entire drumhead and thus tune the drum—in the exemplary prior art drum A there are twelve pairs of tension rods F and lugs D, six on the top and six on the bottom, though only three of the pairs on each of the top and bottom, or six pairs total, are visible in the perspective view of FIG. 1. It will be appreciated by those skilled in the art that the typical prior art system for securing and tuning a drumhead through a number of such conventional tension rod and lug hardware pairs is relatively difficult to use and time-consuming even for experienced drummers. Therefore, it is desirable that a more simplistic approach to securing and tuning a drumhead be provided.

Figure 2:
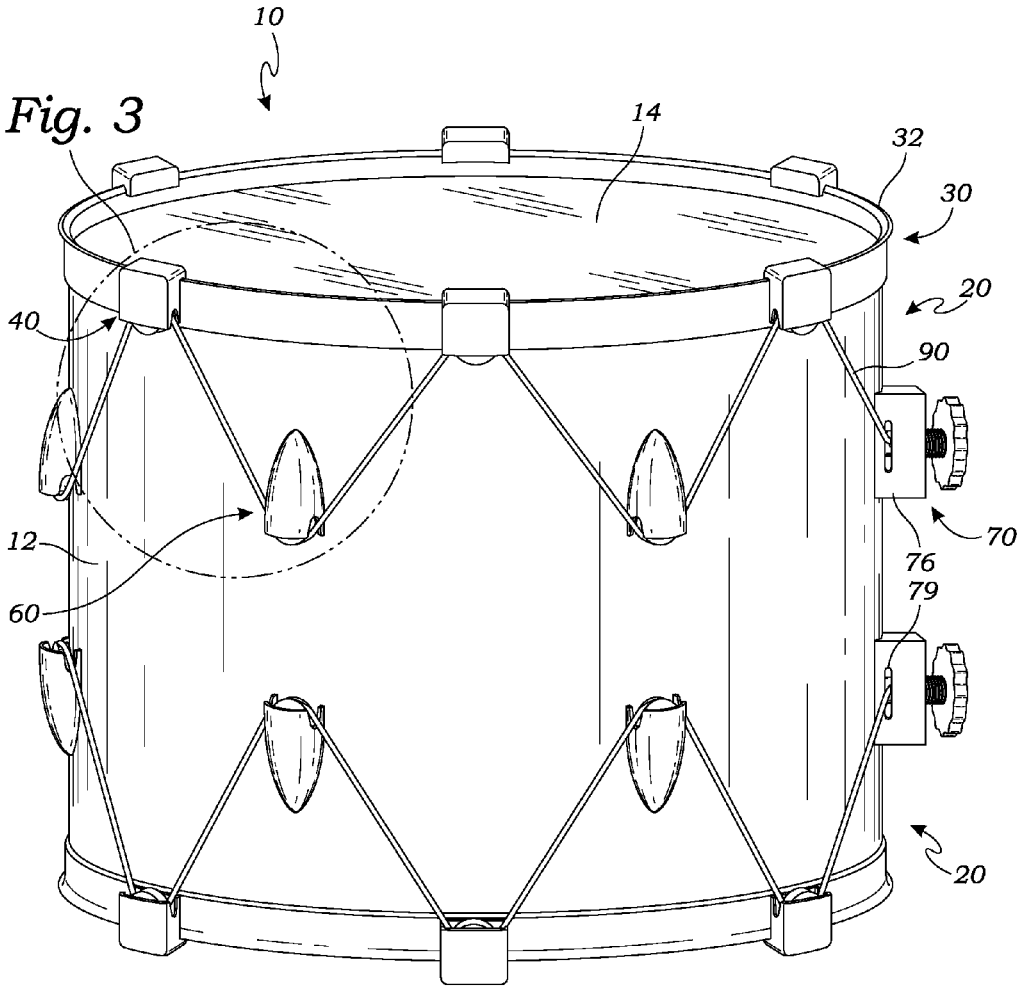
FIG. 2 is a perspective view of an exemplary embodiment of the invention.

Turning now to FIG. 2, there is shown a perspective view of an exemplary embodiment of a drumhead tuning rim apparatus 20 according to aspects of the present invention as employed in connection with a drum 10 having a drum shell 12 and at least one drumhead 14. The apparatus 20 comprises, in one embodiment, a rim 30 configured with spaced-apart grooved bearing wheel housing assemblies 40 about its perimeter and corresponding, spaced-apart grooved bearing wheel lug assemblies 60 installed about the perimeter of the drum shell 12, with a single cable 90 running alternately between the housing assemblies 40 and lug assemblies 60 and terminating at its opposite ends in a cable tension dial assembly 70 also mounted on the drum shell 12 so as to allow, based on the operative cooperation of such components of the apparatus 20, securing and tuning of the drumhead 14 on the drum shell 12 as described further below. As shown in FIG. 2, where the drum 10 has a drumhead 14 positioned on both ends of its hollow drum shell 12, two essentially identical drumhead tuning rim apparatuses 20 may be employed in a similar fashion as herein described, one such apparatus 20 associated with each drumhead 14; it will be appreciated that where a drum is configured as having only one drumhead with the other end of the drum open, only one such drumhead tuning rim apparatus according to aspects of the present invention would thus be employed. Moreover, as will be appreciated from the below discussion of the alternative embodiment of FIGS. 8 and 9, in some arrangements a single drumhead tuning rim apparatus may be employed according to aspects of the invention in tuning two opposed drumheads, whether independently or simultaneously. For simplicity throughout the instant Specification, wherever two are shown in the figures, one drumhead tuning rim apparatus 20 is described in terms of its construction and use, the second again being analogous structure and essentially a mirror image of the first. However, in particular applications it may be desirable to configure the tuning rim apparatuses differently from one another in one or more respects even on the same drum, such as when a different effect or functionality of one drumhead versus another is desired or where the drum and particularly the drum shell and thus the sizes and shapes of the respective drumheads are not identical or symmetrical. Those skilled in the art will appreciate that while a particular configuration of the drumhead tuning rim apparatus 20 is shown and described, the invention is not so limited, but instead may take other forms and involve other components and materials now known or later developed without departing from the spirit and scope of the invention. Furthermore, it is noted that while further aspects of the present invention relate to a system for the electronic or electro-mechanical tuning of a drum employing a drumhead tuning rim apparatus 20 according to aspects of the present invention, it will be appreciated that such a "system" is more broadly to be understood as any arrangement of components according to aspects of the present invention, whether manually operated, electronically or electro-mechanically operated, or otherwise, such that any and all embodiments presented herein are or define a system according to aspects of the present invention.

With continued reference to FIG. 2, a number of grooved bearing wheel housing assemblies 40, six in the exemplary embodiment, are attached or mounted on the rim 30 of the drum 10 at evenly spaced intervals, replacing the traditional tension rod holes formed on the typical hoop rim E (FIG. 1). At substantially equal spacing about the perimeter of the drum shell 12 there are positioned corresponding grooved bearing wheel lug assemblies 60. It is noted that while in the exemplary embodiment there are six grooved bearing wheel housing assemblies 40, there would only be five corresponding grooved bearing wheel lug assemblies 60, as the sixth position about the perimeter of the drum shell 12 between one pair of housing assemblies 40 would instead be taken by the cable tension dial assembly 70, more about which is said below in connection with FIGS. 6 and 7. In the exemplary embodiment, each such lug assembly 60 is located circumferentially substantially midway between the closest two housing assemblies 40. Moreover, the lengthwise offset distance down the drum shell 12 from the rim 30 at which the lug assemblies 60 are located is substantially equal to the circumferential distance from a particular lug assembly 60 to each adjacent housing assembly 40, whereby the angle that the cable 90 bends as it goes through each housing or lug assembly 40, 60 is approximately ninety degrees (90°), though it will be appreciated that this angle can vary depending on a number of factors, such as the desired configuration of the rim 30 and spacing of the housing assemblies 40 thereabout, the type and length of the drum shell 12 and the resulting position thereon of the lug assemblies 60, and the intended drumhead 14 and the amount of tension that is to be put on it, such that it is to be expressly understood that the invention is not limited to the particular positions and spacing of the housing and lug assemblies 40, 60, which are merely illustrative of aspects of the present invention. Relatedly, though the housing assemblies 40 are shown as being at substantially the same locations as would be the tension rods F in a conventional drum A as shown in FIG. 1, or the lug assemblies 60 at substantially the same locations as would be the lugs D, it will be appreciated that such locations of the housing or lug assemblies 40, 60 may vary from those shown without departing from the spirit and scope of the invention. It is noted that while the present invention is shown and described in connection with installation on a drum 10, the components of the drumhead tuning rim apparatus 20 may be sold separately from any drum, such as for an aftermarket installation, in which case it is preferable that the lug assemblies 60 and the cable tension dial assembly 70 be configured to be installed in holes already formed in the drum shell B, or in the locations where the lugs D were originally installed, though again this is not necessary. In any case, it will be appreciated that the components of the drumhead tuning rim apparatus 20, including the rim 30 with housing assemblies 40 thereabout, the lug assemblies 60, the cable tension dial assembly 70, the tensioning cable 90, and assorted bolts and nuts or other fasteners and the like, may be sold as a kit, whereby any prior art drum A can be converted from a conventional tension rod and lug rim securing and tuning system to a "dial-tune" system according to aspects of the present invention. Therefore, while the present invention is shown and described in the context of installation on a drum 10, it is to be understood that the drumhead tuning rim apparatus 20 may exist apart from any such drum, particularly for the purpose of distribution and sales. Relatedly, the housing assemblies 40 of whatever configuration may not only be integrally formed with the rim 30 as by machining, forming, casting, etc. or otherwise permanently mounted thereon as by welding, bonding, etc. but may also be removably engageable with the rim, whether the rim is a prior art rim E as shown in FIG. 1, with the housing assemblies 40 installed or engaged with the traditional tension rod holes formed on the typical hoop rim E, for example, or some other rim formed according to aspects of the present invention, such that the housing assemblies 40 may be formed and sold separately for either aftermarket retrofit applications or simply replacement as desired within installations according to aspects of the invention. Such removable housing assemblies 40 may be attached to the rim 30 using any appropriate technique or device now known or later developed, including but not limited to bolt, pin, hook, clip, slot engagement, press-fit, etc.

Figure 3:
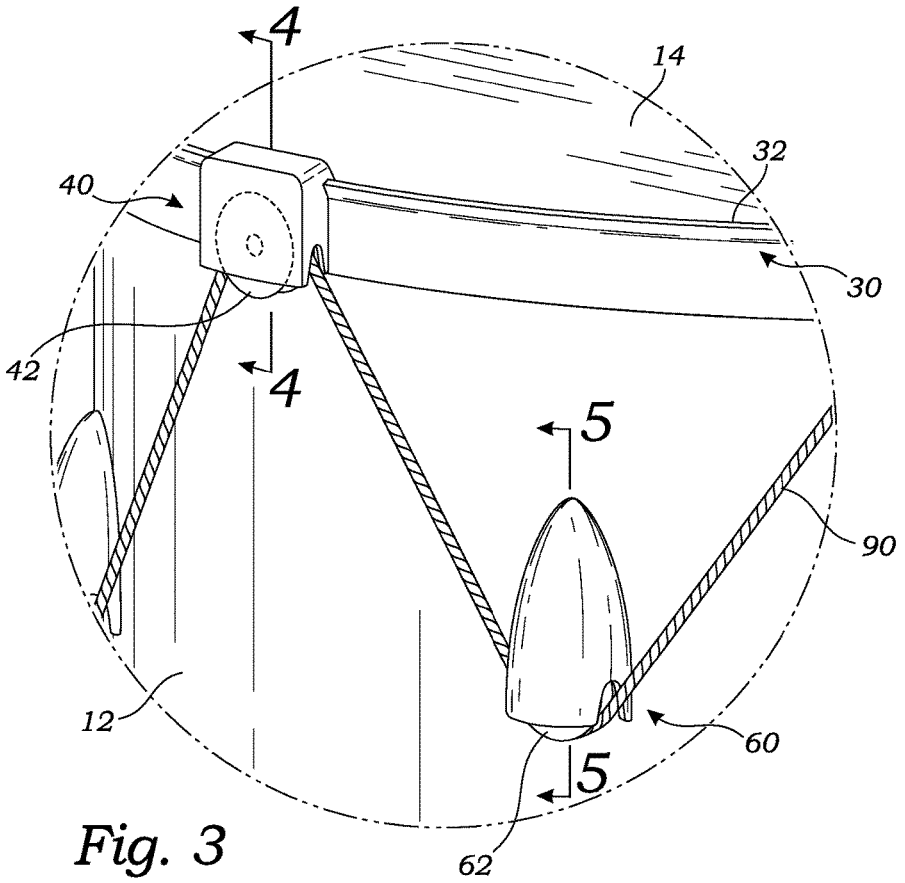
FIG. 3 is an enlarged partial perspective view thereof taken from circle "FIG. 3" of FIG. 2.

Referring next to FIG. 3, there is shown an enlarged partial perspective view of a portion of the drumhead tuning rim apparatus 20 including one each of a grooved bearing wheel housing assembly 40 and an adjacent grooved bearing wheel lug assembly 60 with the tensioning cable 90 passing therebetween on its way around the entire perimeter of the drum shell 12 alternating between such housing and lug assemblies 40, 60 as best shown in FIG. 2. Each housing and lug assembly 40, 60 is thus configured with a grooved bearing wheel 42, 62, respectively, about which the cable 90 runs in a relatively low friction manner as it passes through each component in forming the drumhead tuning rim apparatus 20. In this regard, it will be appreciated that in alternate embodiments the apparatus 20 may not have any wheels 42, 62, but may instead provide other low friction or sliding surfaces on which the cable 90 may run, such as appropriately sized and oriented grooved or notched sliding surfaces. Such sliding-type bearing surfaces may be made of nylon, for example, or any other such low friction material now known or later developed. The cable similarly may be made of a variety of materials now known or later developed, including but not limited to steel or Kevlar® aramid fiber manufactured by DuPont. In a bit more detail regarding the exemplary wheeled bearing approach, and with reference now to FIG. 4, an enlarged cross-sectional view of the grooved bearing wheel housing assembly 40, the housing grooved bearing wheel 42 is formed having a housing central axle 44 that seats in opposite housing channels 48 formed in the housing body 46, such that the housing grooved bearing wheel 42 is rotatably installed within the housing body 46. At the top of the housing body 46 there is further formed a somewhat downwardly-projecting angled flange 50 defining a somewhat downwardly-opening notch 52 within which a corresponding somewhat upwardly extending circumferential upper rim flange 32 of the rim 30 seats in securing the grooved bearing wheel housing assembly 40 on the rim 30. It will be appreciated that while such an interference or tongue-and-groove type installation of the grooved bearing wheel housing assembly 40 on the rim 30 is shown and described, virtually any assembly technique for securing the housing assemblies 40 about the rim 30, whether permanent or selectively removable or now known or later developed, may again be employed in the present invention without departing from its spirit and scope, including but not limited to set screws, bolts, cross-pins, rivets, adhesives, snaps, slotted engagement, spring clips, spot or tack welding, or crimping. It will be further appreciated that the housing body 46 may take any shape or form as desirable in operably containing the housing grooved bearing wheel 42, while in the exemplary embodiment such housing body 46 is configured to be relatively low profile and essentially just large enough to house the housing grooved bearing wheel 42 substantially hidden from view, with notches or the like formed in the side walls of the housing body 46 as needed for free movement of the tension cable 90 about the housing grooved bearing wheel 42; accordingly, any such housing structure capable of functioning as herein described may be employed in the present invention without departing from its spirit and scope. Furthermore, in alternate embodiments, there may be no such housing body 46 at all, but instead such structure, and the housing grooved bearing wheel 42 or other such low friction contact surface for the cable 90, particularly, may be integral with the rim 30 itself; for example, in the case of a bearing wheel, it may simply be rotatably mounted on the rim 30 as by having an axle protruding outwardly therefrom, such that it will be appreciated that the configuration of the housing assembly 40 shown and described herein is merely illustrative of aspects of the invention and non-limiting. Again, in other contexts there may be no wheels at all, but instead low friction surfaces for the cable to ride on attached to or otherwise incorporated into the rim.

Figure 5:
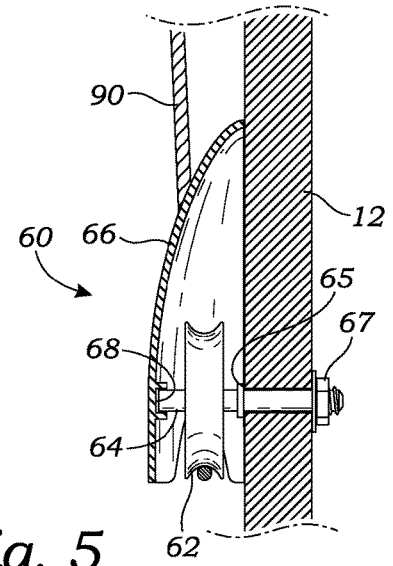
FIG. 5 is an enlarged cross-sectional view taken along line 5-5 of FIG. 3.

Referring to FIG. 5, another enlarged cross-sectional view, the complimentary grooved bearing wheel lug assembly 60 is shown as being configured similarly to the grooved bearing wheel housing assembly 40, with a lug body 66 in which is formed, here, one lug channel 68 wherein one end of a lug central axle 64 of the lug grooved bearing wheel 62 is seated. Rather than being supported at the axle 64's opposite end by another channel formed in the lug body 66, the back of the lug body 66 toward the drum shell 12 is open, and the axle 64 extends inwardly through the lug grooved bearing wheel 62 and a corresponding cross-hole formed in the drum shell 12 to thereby fasten the grooved bearing wheel lug assembly 60 onto the drum shell 12. Specifically, in the exemplary embodiment, the lug central axle 64 is formed opposite its free end that seats in the lug channel 68 with an axle flange 65 configured to abut the drum shell 12 and so space the lug grooved bearing wheel 62 away from the drum shell 12 for free rotation within the lug body 66 about the lug axle 64. The opposite end of the lug axle 64 is then threaded for receipt of a nut 67, with or without a washer, in the conventional fashion, whereby the axle 64 is secured to the drum shell 12 by clamping the shell 12 between the axle flange 65 and a nut 67. Once more, while a particular means for securing the grooved bearing wheel lug assembly 60 onto the drum shell 12 is shown and described, it will be appreciated that any installation method and related hardware, whether permanent or selectively removable or now known or later developed, may be employed without departing from the spirit and scope of the invention. Specifically, the end of the axle 64 may be secured within the channel 68 such that the lug body 66 is thereby also secured to the drum shell 12 by way of the axle 64; or the lug body 66 may be separately installed on the drum shell 12 employing any appropriate means now known or later developed. Moreover, while the lug body 66 is shown as having a somewhat teardrop shape for aesthetic purposes, it is to be appreciated that any styling will do as long as it does not compromise function. Relatedly, the lug body 66 in the exemplary embodiment is configured such that the lug grooved bearing wheel 62 is substantially hidden by the lug body 66, with slots or notches formed in the lug body 66 as needed for passage of the cable 90 even with the lug grooved bearing wheel 62 tucked up under the lug body 66 as shown. Again, those skilled in the art will appreciate that such aesthetic considerations and related form and function of the components may vary from that shown without departing from the spirit and scope of the invention. For example, there need not be a lug body 66 necessarily at all, wherein the lug grooved bearing wheel 62 or other such low friction sliding surface for the cable 90 may be installed directly on or somehow incorporated into the drum shell 12 itself, as noted above for the optional housing body 46.

Figure 6A:
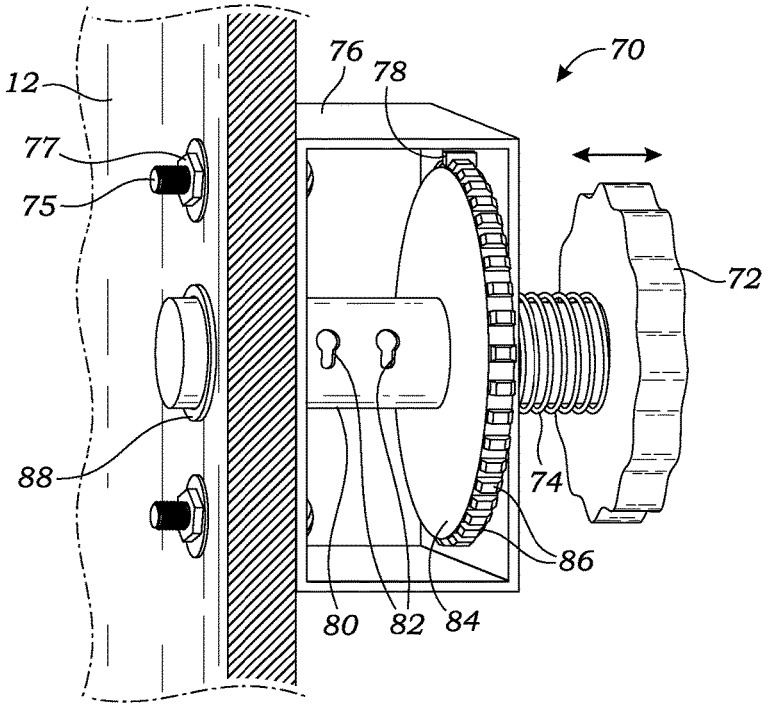
FIGS. 6A and 6B are enlarged partial perspective views thereof in two operative states.
Figure 6B:
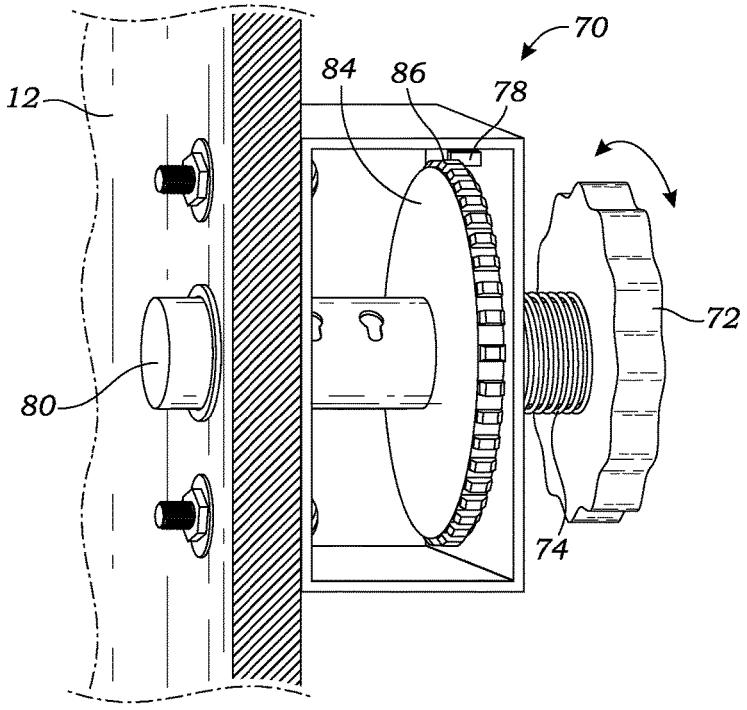

Turning now to FIGS. 6A and 6B, there are shown enlarged partial perspective views of the cable tension dial assembly 70 of the drumhead tuning rim apparatus 20 in two operative states. For simplicity and ease of viewing the inner components of the cable tension dial assembly 70, the side portion or side wall of the cable tension dial body 76 is removed and the tension cable 90 (FIG. 2) is not shown. Generally, the cable tension dial assembly 70 comprises a knob or dial 72 installed on a geared shaft 80 operable within the cable tension dial body 76 for selective rotation as by turning the dial 72 so as to increase or decrease the tension in the cable 90 (FIG. 2). In a bit more detail, the dial body 76 is configured as a substantially box-like enclosure that may be installed on the drum shell 12 in any appropriate manner, though as shown this is accomplished through a pair of small bolts 75 and associated nuts 77, with or without washers. It will be appreciated by those skilled in the art that virtually any assembly technique for securing the one or more cable tension dial assemblies 70 on the drum shell 12, whether permanent or selectively removable or now known or later developed, may be employed in the present invention without departing from its spirit and scope, including but not limited to screws, bolts, cross-pins, rivets, adhesives, snaps, slotted engagement, spot or tack welding, or crimping. It will be further appreciated that the dial body 76 may take any shape, size or form as desirable in operably containing the shaft 80 with gear 84, while in the exemplary embodiment such dial body 76 is configured to be relatively low profile and essentially just large enough to house an operably sized shaft 80 and gear 84. As best seen in FIG. 2, the dial body 76 in the exemplary embodiment forms a substantially complete enclosure about the moving parts shown in FIGS. 6A and 6B of the cable tension dial assembly 70, with small slots or openings 79 formed in the dial body 76 at appropriate locations for the passage therethrough of the tension cable 90. Small rollers or other such reduced friction surface may be employed in or about the openings 79 as needed in allowing for the relatively free or guided movement of the cable 90 therethrough during use of the drumhead tuning rim apparatus 20 as described further below. Accordingly, any such housing structure capable of functioning as herein described may be employed in the present invention in connection with the cable tension dial assembly 70 without departing from its spirit and scope.

Figure 8:
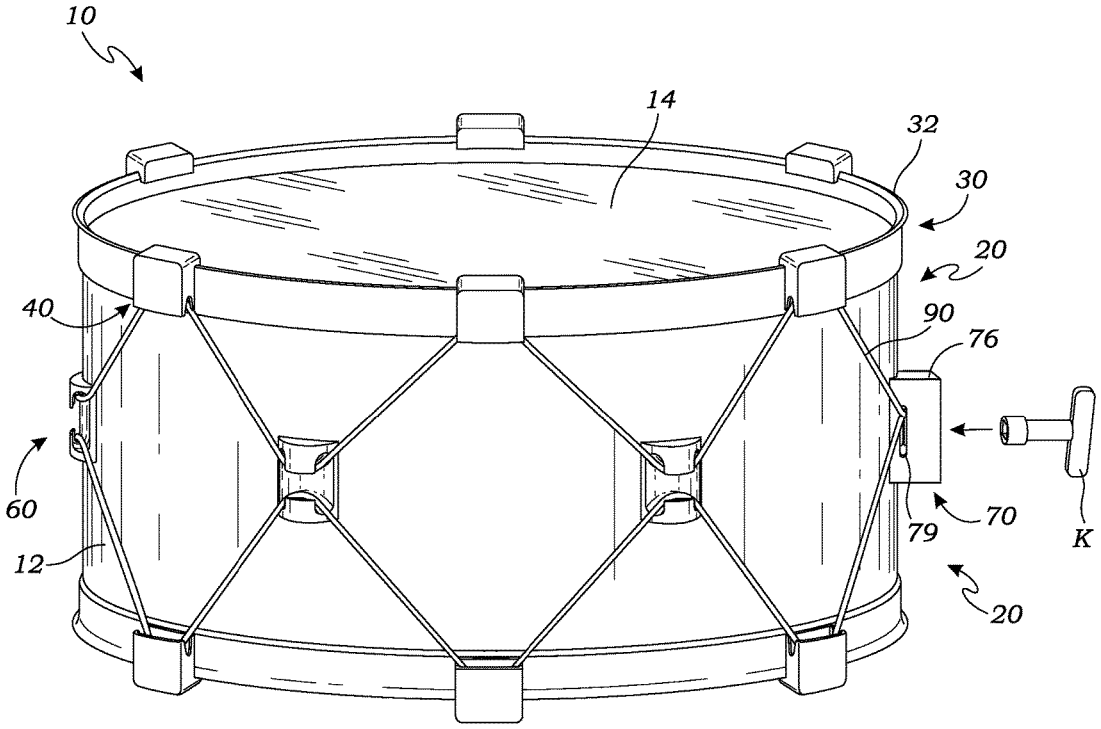
FIG. 8 is a perspective view of an alternative exemplary embodiment of the invention.
Figure 9:
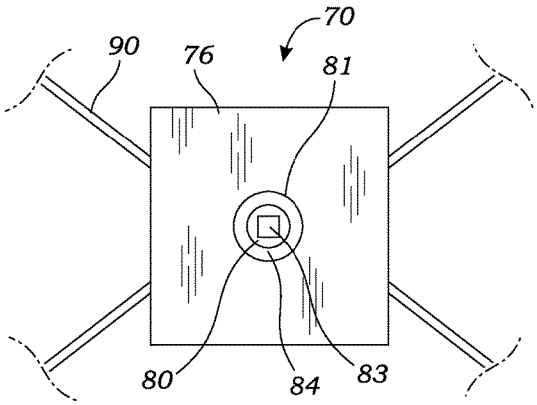
FIG. 9 is an enlarged partial side view thereof.

With continued reference to FIGS. 6A and 6B, positioned substantially centrally within the cable tension dial body 76 is the shaft 80, passing through one or more substantially axially aligned openings (not shown) in the dial body 76 and, in the exemplary embodiment, the drum shell 12. It will be appreciated that in alternate embodiments wherein the dial body 76 is sufficiently spaced from the drum shell 12 or the shaft 80 is otherwise operably supported on both ends spaced from the drum shell 12, an opening for the shaft 80 in the drum shell 12 itself would not be necessary. However, in the exemplary embodiment, in the interest of further supporting the shaft 80 and flushing to the extent possible the cable tension dial assembly 70 on the drum shell 12, the shaft 80 is shown as at least partially passing through the drum shell 12 as through a hole therein (not shown), in which case, though the dial body 76 is shown as having a rear wall immediately adjacent the drum shell 12, it will be appreciated that such wall may be eliminated in whole or in part, particularly where alternate assembly techniques for securing the cable tension dial assemblies 70 on the drum shell 12 are employed. To facilitate relatively frictionless axial and rotational movement of the shaft 80 through such drum shell hole or any opening in the dial body 76, a bushing 88 or the like may be positioned therein. Along the shaft 80 within the dial body 76 there is installed a gear 84 having multiple teeth 86. And between the gear 84 and the drum shell 12 there are formed in or along the shaft 80 one or more shaft holes 82 configured for receipt therein of the free ends of the tension cable 90 as it starts and ends within the cable tension dial assembly 70. In this way, it will generally be appreciated by those skilled in the art that with the ends of the cable 90 attached or secured to the shaft 80 in any appropriate manner now known or later developed and the rest of the cable 90 passing alternately through the housing and lug assemblies 40, 60 of the drumhead tuning rim apparatus 20, as above-described in connection with FIGS. 2-5, rotation of the shaft 80 will effectively increase or decrease the tension in the cable 90 and thus raise or lower the overall pitch of the drumhead 14 (FIG. 2) as explained further below. In the exemplary embodiment, the gear 84 is relatively fine-toothed for relatively small incremental ratcheting of the tension in the cable 90, though it will be appreciated that any configuration of the gear 84 and its teeth 86 or other such mechanical means for incrementally rotating the shaft 80 and thus increasing or decreasing the tension in the cable 90 may be employed without departing from the spirit and scope of the invention. At least one pin 78 is formed on the inside of the dial body 76 so as to selectively engage the teeth 86 of the gear 84. Thus, it will be appreciated that when the gear teeth 86 are in contact with the pin 78, the gear 84 and thus the shaft 80 is unable to rotate, thereby "locking" the cable tension as shown in the first operational state of FIG. 6A. While if the shaft 80 is pushed inwardly or in axially toward the drum shell 12, the teeth 86 of the gear 84 would thus be disengaged from the pin 78, thereby allowing the shaft 80 to freely rotate and the tension in the cable 90 to be adjusted as shown in the second operational state of FIG. 6B. Pushing or pulling on or rotating the shaft 80 is facilitated by the dial 72 installed on the free or proximal end of the shaft 80 outside of the dial body 76. In the exemplary embodiment, the dial 72 is formed having an overall size and shape and with grooves, bumps, ribs, knurls or other such surface features to enhance grasping or manipulating the dial 72 in a manner known in the art. It will be appreciated that any appropriate form of the dial 72 accounting for ergonomic, manufacturing and assembly, or other such considerations may be employed in the present invention without departing from its spirit and scope. Furthermore, the dial 72 may be integrally or permanently installed on the shaft 80 or may be temporarily or removably engaged therewith so that the dial 72 can be removed when no tuning is needed to prevent inadvertent adjustment and to again further flush the cable tension dial assembly 70 on the drum shell 12. In a further alternate embodiment, as shown in FIGS. 8 and 9, rather than a dial 72, a traditional drum key K may be employed through engagement with a dial lug 83 formed on the end of the shaft 80, more about which is said below. In this context it will be appreciated that such a drum key K or the dial 72 of the present embodiment effectively serve as an "apparatus controller" enabling adjustment of the drumhead 14 through interaction with the cable tension dial assembly 70. About the shaft 80 between the dial 72 and the dial body 76 there is positioned a compression spring 74 configured to bias the shaft 80 outwardly such that the gear 84 abuts the inside surface of the dial body 76 and the gear teeth 86 are thereby engaged with the pin 78, once again "locking" the dial assembly 70 and so "setting" the cable tension and thus the particular tuning of the drumhead 14 (FIG. 2). Those skilled in the art will appreciate that alternative configurations of the cable tension dial assembly 70 and its components are possible without departing from the spirit and scope of the present invention. For example, it is possible that the gear 84 could be located at the other end of the shaft 80, whether still within the dial body 76 and potentially resulting in the shaft 80 being pulled rather than pushed to disengage the gear teeth 86 from a pin or the like, or even positioning the gear 84 on the far end of the shaft 80 inside the drum shell 12 and otherwise operating much as described above, thereby potentially further flushing the dial assembly 70 with the drum 10 (FIG. 2) or reducing its overall size, particularly on the outside of the drum as a protrusion. Moreover, the pin 78 may be spring-loaded rather than fixed in order to lock the gear 84 from turning. In this way, when turning the dial 72 and thus the shaft 80 to tighten the cable 90 (FIG. 2), it is not necessary to push in or pull out on the dial 72 in order to free the gear 84; instead, simply rotating the dial 72, in the exemplary embodiment clockwise, would tighten the cable "click by click," locking into place at a particular tension with each "click," and then to loosen the cable, one would simply push in on the dial 72 as described above to release. It will be further appreciated that any and all such components of the drumhead tuning rim apparatus 20 may be formed of any suitable material, such as metal or plastic, through any suitable fabrication process, such as molding, casting, machining, stamping, or forming, whether now known or later developed. Further non-limiting variations in how the cable tension dial assembly 70 is configured and operates include dual ratcheting wherein the dial gear 84 ratchets in either direction, the use of other locking mechanisms now known or later developed to maintain tension, a quick release button, lever, or function to let out the cable 90 quickly for tuning, instead of or in addition to the exemplary push-pull activation and release of the dial 72, and relatedly, a cable 90 that can be disconnected from the take up spool or shaft 80 or one that is permanently attached to the spool or a function to release and attach at least one end of the cable 90, in any case to selectively allow for quick removal and replacement of the drumhead 14 and rapid tuning. It is also possible in particular contexts that there would be a cable tension dial assembly 70 on more than one side of the drum shell 12 even for the same drumhead 14, whereby the assembly could be more easily accessed from multiple directions depending on such factors as the drum kit configuration and even the user's preference in terms of being right-handed or left-handed. Again, it will be appreciated that numerous other variations of the cable tension dial assembly 70 and the overall drumhead tuning rim apparatus 20 beyond those shown and described are possible without departing from the spirit and scope of the present invention.

As a still further example, though not shown, it will be appreciated that structure and assemblies as herein described as together generally comprising a drumhead tuning rim apparatus according to aspects of the present invention may be arranged and mounted in a variety of other ways, even including the incorporation or installation of much of the hardware on the inside of the drum shell rather than on the outside as shown, specifically including the option of running the cable(s) through the inside of the drum. One method by which this could be accomplished would be through the use of frictionless eye-holes in the drum shell through which the cable runs from the outside of the shell into the inside where the lug bearing wheels or surfaces would be positioned, the cable still in this embodiment passing through the shell so as to operably engage rim bearing wheels or surfaces still located on the outside or perimeter of the rim. The take-up reel or cable tension dial assembly for the cable itself could be located inside the drum as well, with only the dial portion on the outside. And as above-described, the dial itself could be removable or even be replaced with a traditional drum key, such that all that would be visible on the outside of the drum in the way of hardware would be one or more holes or openings in the drum shell corresponding to the end of the assembly tuning shaft for access by the dial or key, and in the exemplary embodiment just a portion of the cables running out of the shell up and around the rim bearing wheels or surfaces. Moreover, it is possible that the rim bearing wheels or surfaces could themselves be positioned inside of the drum shell such that no portion of even any cable is on the outside of the drum, as for example by modifying the rim to extend downwardly and radially inwardly through openings in the shell or to extend upwardly and radially inwardly and forming small holes in the drum head, in either case thereby moving the rim bearing wheels or surfaces interiorly such that any cable is substantially contained within the shell. It will again be appreciated that any such modifications to or variations of such a drumhead tuning rim apparatus according to aspects of the present invention are possible, such that any specific hardware configurations shown and described herein are to be understood as merely illustrative of features and aspects of the invention and non-limiting. In any case, it will be appreciated that to the extent some or all of the hardware components are housed inside the drum, the less the outer appearance of the drum is altered and the less likely any such hardware could be inadvertently damaged during storage, transport, or use. Moreover, by having relatively more of the hardware contained within the inside of the drum, the less likely it would be that any modifications to traditional drum stands and the like would be needed or preferred, particularly for bass drums that are typically placed on their side during use, in which case in embodiments wherein the hardware and cable(s) are on the outside of the drum, a modified stand or other support might be needed, though not necessarily depending on a number of factors.

Figure 4:
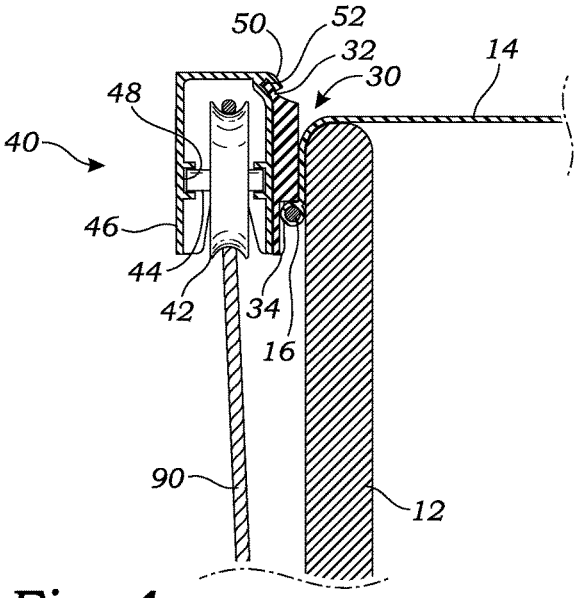
FIG. 4 is an enlarged cross-sectional view taken along line 4-4 of FIG. 3.
Figure 7:
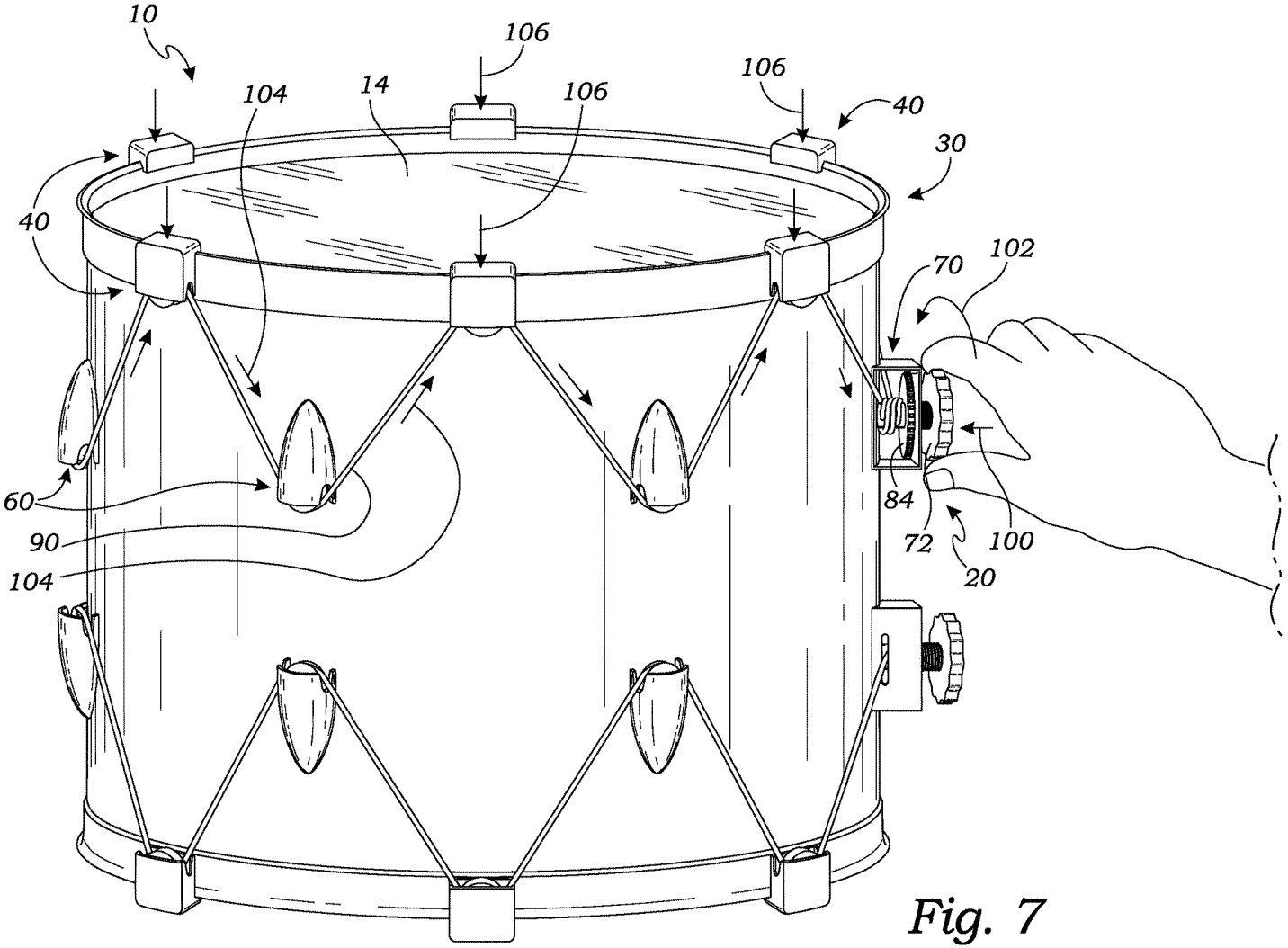
FIG. 7 is a perspective view of the exemplary embodiment of FIG. 2 in use.

Referring now to FIG. 7, in use of the drumhead tuning rim apparatus 20 of the present invention as shown and described in connection with the exemplary embodiment of FIGS. 2-6, installation begins with passing the thin gauge steel or other cable 90 through each of the grooved bearing wheel housing assemblies 40 on the rim 30, leaving the two ends of the cable 90 facing each other between any two of the grooved bearing wheel housing assemblies 40. To mount the drumhead 14, it is simply placed on top of the drum shell 12 in the conventional manner, and then the rim 30 with steel cable 90 in place passing through the grooved bearing wheel housing assemblies 40 is positioned over the drumhead 14 so that the free ends of the cable 90 are substantially adjacent the corresponding cable tension dial assembly 70 and there is substantially equal spacing between the grooved bearing wheel housing assemblies 40 and the grooved bearing wheel lug assemblies 60. It is particularly noted with reference to FIG. 4 that the rim 30 is formed in the conventional manner with a downwardly-opening recess 34 within which is seated the hoop 16 typically formed about the perimeter edge of the drumhead 14 for trapping the drumhead 14's perimeter between the rim 30 and drum shell 12, thus allowing the drumhead 14 to be secured and pulled taught as the rim 30 is tightened down, by individual tension rods F and threaded lugs D in the prior art approach (FIG. 1) or by the operation of the single dial 72 as in the present invention. Once the rim 30 is properly positioned over the drumhead 14 on the drum shell 12, the still loose cable 90 between each grooved bearing wheel housing assembly 40 may be pulled down and looped under the respective grooved bearing wheel lug assembly 60 mounted around the drum shell 12, being careful that the cable 90 is properly seated on each grooved bearing wheel 42, 62 (FIGS. 3-5). In this manner the cable 90 passes alternately from housing 40 to lug 60 to housing 40 around the drum 10. Next, in the case of a first time installation, the free ends of the cable 90 are attached to the shaft 80 of the cable tension dial assembly 70, such as by fitting a metal notch or crimped connector (not shown) on each end of the cable 90 into the fitted or keyed slot or hole 82 in the shaft 80 (FIG. 6). Once the cable 90 is thus secured to the shaft 80 of the cable tension dial assembly 70, simply pressing in on the dial 72 as indicated by arrow 100 disengages the gear 84 as above-described; turning the dial 72 as indicated by arrow 102 then winds the cable 90 about the shaft 80 until the slack is taken out of the cable 90 at all points. Further turning with the dial 72 still pushed in then tightens the cable 90 and thereby increases tension in the cable 90 as indicated by arrows 104, which results in substantially equal downward force at each of the grooved bearing wheel housing assemblies 40 as indicated by arrows 106, and thus across the entire rim 30, resulting in substantially uniform tautness or tuning of the drumhead 14. Once the drum 10 is tuned as desired, pulling out on or simply releasing the dial 72 again locks the gear 84 in place and thereby holds the desired tension on the cable 90. The drum 10 now has the drumhead 14 installed and tuned. It will be appreciated that once any drum 10 is so configured with a drumhead tuning rim apparatus 20 according to aspects of the present invention, replacing a drumhead 14 does not require complete disassembly or removal of the cable 90 from the cable tension dial assembly 70 such that the above steps must be repeated from the beginning. Rather, by simply loosening the cable 90 enough, or putting sufficient slack in the cable 90 as by pushing in the dial 72 and turning it opposite the direction it was tightened so as to "unwind" the cable 90 from the shaft 80, the cable 90 can be removed from underneath the grooved bearing wheel lug assemblies 60, and the rim 30 can simply be lifted off the drum shell 12 and the current drumhead 14 slipped out and a new one slipped in. The rim 30 can then once more be seated on the drumhead 14, again being careful to position the rim 30 such that the housing assemblies 40 are substantially equally spaced from the respective lug assemblies 60, the cable 90 looped beneath the grooved bearing wheel lug assemblies 60, and the dial 72 simply turned to retighten the cable 90 and tune the drum 10 as desired. It will be appreciated by those skilled in the art that similar or related methodologies would be employed according to aspects of the present invention depending on the hardware configuration of the apparatus 20 in use, such that the above-described steps in use are to be understood as merely illustrative and non-limiting.

There are obvious advantages of the drumhead tuning rim apparatus 20 of the present invention over the traditional lug D and tension rod F arrangement. First is the ease with which the drum 10 can be tuned and re-tuned. A person need not be a professional drummer or stage hand to relatively easily and effectively tune the drum 10 to the sound desired. According to aspects of the exemplary embodiment of the invention, simply pressing in the dial 72, turning to tune, and pulling out or releasing the dial 72 to lock it in place is essentially all that is required. One dial and no individual lugs to be tightened means that tuning takes a matter of seconds as opposed to the old method of tuning the drum to itself one tension rod F at a time before raising or lowering the over-all pitch, which itself still required adjusting each of six to twelve tension rods F by the same amount to keep the drum in tune with itself across the head C while adjusting the pitch. Not only is this prior art approach time consuming, but it is very difficult to be precise and it is a daunting task to many drummers. With the present invention, the drum 10 will consistently be substantially in tune with itself, with the pitch of the drum raised or lowered to achieve the desired sound simply with the turn of a single dial 72. Another advantage of the present invention is the relative speed and ease of changing out an old or torn drumhead 14. Rather than removing each individual tension rod F before being able to remove the rim E and thus the drumhead C, with the present invention it is as simple as pressing in on the dial 72 and letting the cable 90 go slack and then slipping the cable 90 from under each bearing lug 60, whereby the rim 30 and drumhead 14 are ready to come off. Installation of the new drumhead 14 is essentially just as easy by following these same steps in reverse. Once more, other such advantages and benefits in use may be realized depending on the context.

Turning now to the alternative embodiment of FIGS. 8 and 9, there is shown a drum 10, here in the form of a snare drum or the like having a relatively shorter drum shell 12, with an alternative drumhead tuning rim apparatus 20 according to aspects of the present invention installed thereon. As can be seen, in this arrangement, single substantially central grooved cable lug assemblies 60 are installed spaced about the drum shell 12, each such assembly 60 having opposed downwardly and upwardly opening grooves or notches in which the respective upper and lower cables 90 run. It will be appreciated that a similar central lug assembly 60 more analogous to the first exemplary embodiment of FIGS. 2-6 could be employed, only here having two bearing wheels rather than cable grooves, whether the wheels are offset as the grooves or "stacked" one over the other so as to share a common shaft or axle. Similarly, there may be low-friction sliding surfaces such as pins or molded surfaces within the rim housing assemblies 40 rather than bearing wheels, which are not shown in the alternative embodiment of FIG. 8, though again those skilled in the art will appreciate that grooved bearing wheel housing assemblies 40 as in the embodiment of FIGS. 2-7 may again be employed in the present alternative embodiment. Moreover, it will be appreciated that any combination of such bearing features or surfaces is possible in various contexts, such as bearing wheels employed in the rim housing assemblies 40 and low-friction sliding surfaces as shown in FIG. 8 for the lug assemblies 60 or vice versa, or there may even be occasion for mixed uses of such devices within a single apparatus installation, such as using, alternately or otherwise, bearing wheels and bearing surfaces, in either or both the rim housing assemblies 40 and/or the cable lug assemblies 60 or any other substantially functionally equivalent structure now known or later developed. While such an alternative apparatus 20 according to aspects of the present invention is shown and described in connection with a relatively shorter snare drum, it will be appreciated that a similar approach can be employed with drums of virtually any size and shape, including toms as shown in FIGS. 2 and 7, with only the cable 90 potentially changing its angle as it winds away through the alternating housing and lug assemblies 40, 60, though even the cable angle may be maintained as desired by simply adjusting the spacing between respective housing and lug assemblies 40, 60.

With continued reference to FIG. 8, not only are there shown in the alternative embodiment a single row of shared lug assemblies 60, there is accordingly a single cable tension dial assembly 70 mounted on the drum shell 12 as well, though it will be appreciated that in certain contexts there still could be multiple dial assemblies 70, such as one for each cable and head 14, even if the cables 90 still share common lug assemblies 60 as shown, or vice versa with a single dial assembly 70 but two rows of lug assemblies 60. In any event, as shown in FIG. 8, a single cable tension dial assembly 70 is mounted on the drum shell 12 so as to have slots 79 formed in the housing body 76 through which cables 90 corresponding to the upper and lower drum heads 14 both run. Internally within the dial assembly 70 a shaft and gear arrangement as above-described in connection with FIGS. 2-7 or any other such mechanical arrangement, now known or later developed, consistent with aspects of the present invention may be operably configured, with the cables 90 both wrapping the dial shaft in the same direction so that turning one direction (e.g., clockwise) simultaneously tightens both heads and turning the other direction (e.g., counterclockwise) simultaneously loosens both. Alternatively, the dial assembly 70 may be mechanically arranged such that gearing is selectively engaged based on the use of a switch so that the manipulable dial or key is able to control either the top head or the bottom head independently, in which case it would be necessary that each cable be on a separate shaft or spool, which shaft is again independently and selectively controlled based on the gearing as controlled by the switch. Another possibility would be a middle option that raises and lowers the tension on the opposing heads simultaneously in order to maintain equal variation between head tension while raising and lowering the overall pitch of the drum. Fundamentally, those skilled in the art will appreciate that a variety of mechanical arrangements beyond those disclosed may be employed according to aspects of the present invention without departing from its spirit and scope. Referring still to FIG. 8 and with further reference to FIG. 9, there is shown a drum key K selectively engageable and operable with the cable tension dial assembly 70, rather than a permanent or removable dial 72 as in the embodiment of FIGS. 2-7. Particularly, in this alternative embodiment, a traditional drum key K engages a square dial lug 83 formed on the distal or free end of the dial shaft 80 that is accessible through the opening 81 formed in the dial body 76. The key and lug engagement may be as with standard drum kits, enabling use of a typical drum key K to tune even a drum configured with a new and novel drum tuning rim apparatus 20 according to aspects of the present invention, here still from a single central dial assembly 70, whether for both heads simultaneously or each independently, rather than multiple lugs being individually adjusted to tune a single head as in prior art arrangements. It will be appreciated that other geometrical engagements beyond the exemplary square geometry are possible. As best seen in the enlarged side view inset of FIG. 9 looking into the cable tension dial assembly 70, through the opening 81 there is seen and accessed the internal dial shaft 80 having the outwardly protruding square dial lug 83 with a portion of the gear 84 visible as well, with the square lug 83 again being engageable by the key K, it having an appropriately sized and configured female receptacle feature to engage the square lug 83 in a manner known in the art. Once more, those skilled in the art will appreciate that a variety of other geometrical and mechanical arrangements of the cable tension dial assembly 70 and the overall drum head tuning rim apparatus 10 are possible without departing from the spirit and scope of the invention.

Figure 10:
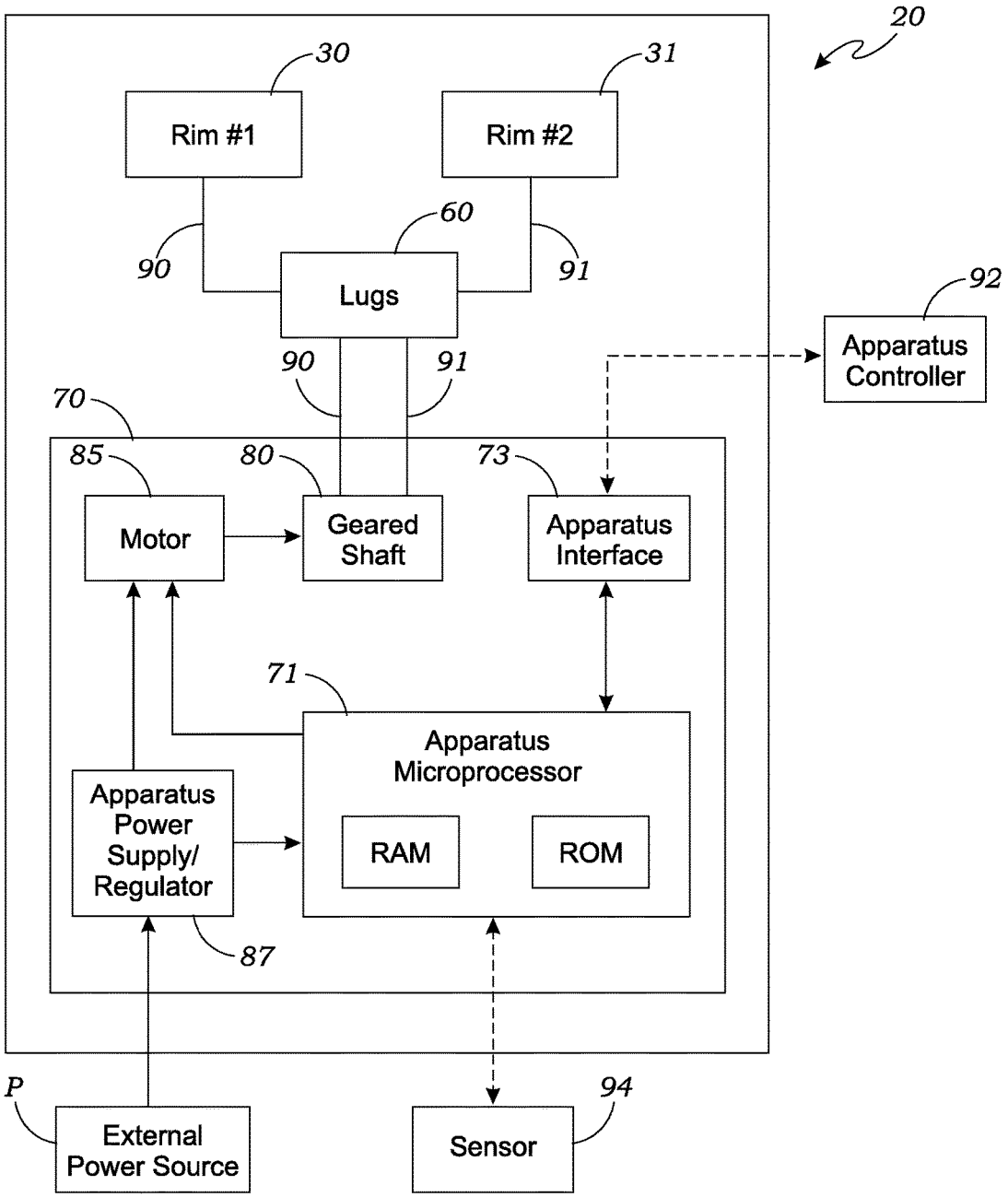
FIG. 10 is a block diagram schematic representation of a further alternative embodiment of the invention.
Figure 11:
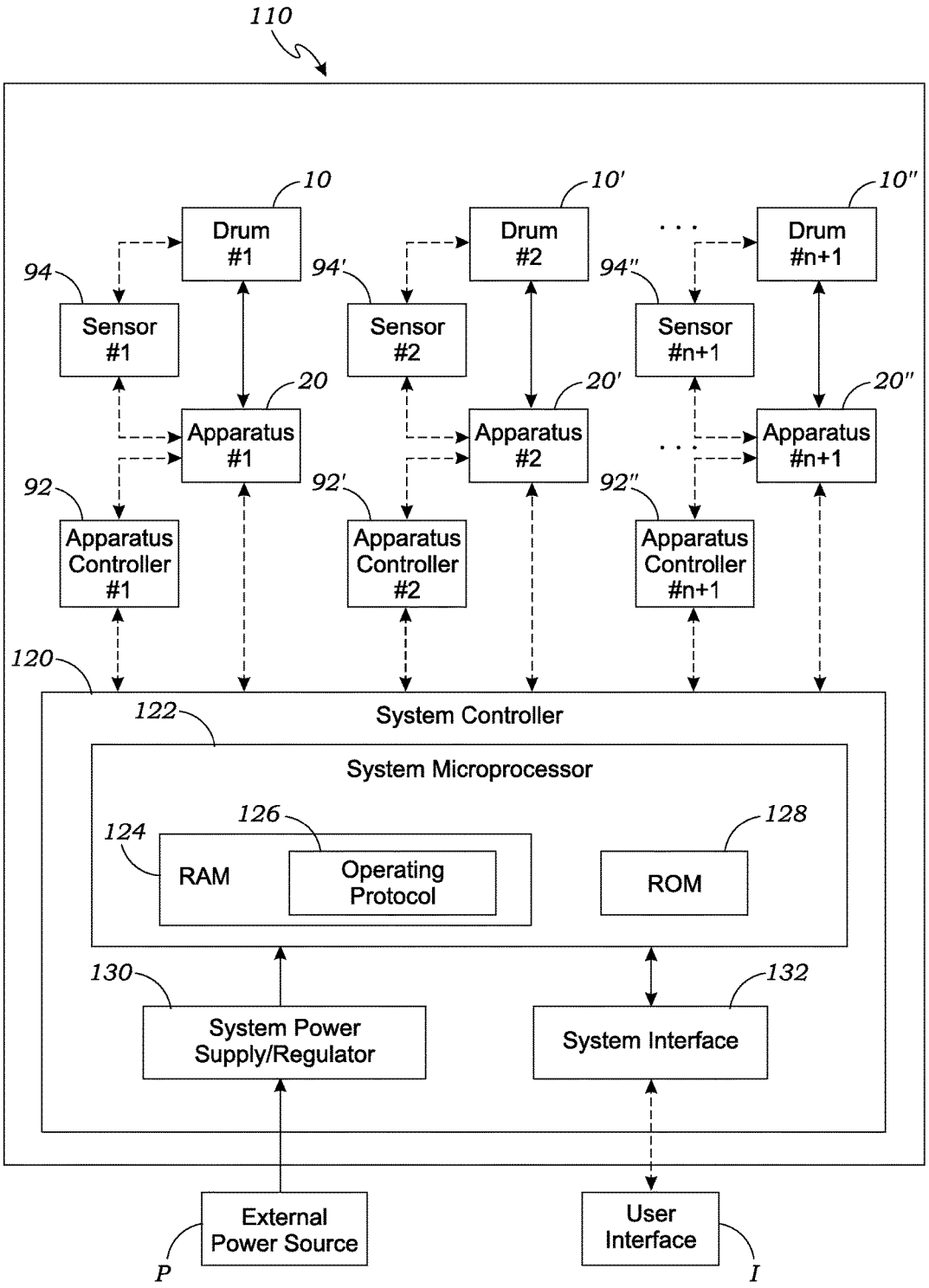
FIG. 11 is a block diagram schematic representation of a still further alternative embodiment of the invention.

Referring next to FIGS. 10 and 11, there are shown schematic block diagrams essentially depicting the new and novel idea of controlling the tuning of an acoustic drum or drum kit electronically (or electro-mechanically), as by having a motor 85 drive the geared shaft 80 of a drum head tuning rim apparatus 20 according to aspects of the present invention in order to tune each drum "up" or "down," with a microprocessor 71 allowing for control through a wired or wireless connection between the apparatus interface 73 and an external controller 92, more about which is said below. Those skilled in the art will appreciate that such a system and method thus enables a conventional drum or drum kit to be tuned in an efficient or even automated manner as by electronic or electro-mechanical control yet with the full, rich, traditional sound and playability of an acoustic drum or drum kit. The resulting system is effectively and advantageously an acoustic-electric hybrid system that can be employed to create or enable an acoustic drum that is even self-tuning and/or self-adjusting. Applications of such a system could include but are not limited to eliminating the need for a drummer to tune his own drum set, allowing the drum set to tune itself and continually maintain tuning through a self-adjusting system, to allow a drummer to customize his tuning preferences and to easily and accurately duplicate those preferences, to allow an acoustic drum set to interact with technology in a way that makes it possible to have preset tuning options saved into an electronic interface (similar to how an electric guitar pedal works) and to access those options with the click of a button. A drummer could potentially adjust the tuning of his entire drum set instantaneously during live play, either between songs or during different sections of a song, for example during a key change. Such a system and method would thus be extremely beneficial for recording studio purposes as well, where rather than spending time and money re-tuning a drum set between songs, or bringing in a separate drum set, an artist could instead access his or her preset tuning options, instantaneously and automatically re-tuning the entire drum set between each song in the recording session. Relatedly, further applications of the present technology could also include a link, via Bluetooth® or any other wireless technology or protocol now known or later developed, between the acoustic drum set and an app on a smart phone, computer, or other technology for the purpose of uploading, downloading, and sharing tuning options as well as saving personal tuning settings and adjusting the drum set on the fly or even from a distance away. Those skilled in the art will appreciate that a variety of system configurations are possible within the spirit and scope of the invention, which will be further appreciated from the following discussion relating to FIGS. 10 and 11 in more detail.

With continued reference first to FIG. 10, there is again shown a schematic block diagram depicting a system for controlling the tuning of an acoustic drum electronically or electro-mechanically. Rather than manually turning the geared shaft 80 as through a dial 72 (FIGS. 6 and 7) or a drum key K (FIG. 8) that adjusts the tension in the cables 90, 91 to the respective upper and lower rims 30, 31 (labeled "Rim #1" and "Rim #2"), a motor 85 instead turns the shaft 80 under the control of a microprocessor 71. It is noted that while the shaft 80 is still described as "geared," it is not necessarily literally so, but instead may be "geared" in the sense that it is driven at various speeds and/or with various amounts of torque under the control of the motor 85, the motor 85 then functionally providing all of the "gearing" for the drive shaft 80. It is further noted that while a single shaft 80 is shown in FIG. 10, the invention is not so limited, as will be appreciated from the foregoing discussion relating to alternative embodiments, and so might entail multiple gear shafts, each driven by the same motor 85 as by effectively a transmission that selective shifts the drive shaft of the motor 85 into engagement with one shaft or the other or neither. Or, there may be employed a separate motor 85 for each shaft 80 when a separate shaft 80 is to be provided for each cable/rim/head set. In any case, the one or more geared shafts 80 may be biased to a locked or non-rotatable position when not being driven, whether still engaged with the motor drive shaft or not, such that whatever setting the shaft is turned to, and hence whatever tension is in a particular cable and whatever resulting tuning of the associated head has been selected, it will remain until a different selection is made and the particular shaft 80 is again driven by the motor 85. Again, here, there are shown a first cable 90 operably engaged with both the geared shaft 80 and the central bearing lugs 60 and the first or upper rim 30 and a second cable 91 also operably engaged with both the geared shaft 80 and the bearing lugs 60 and then the second or lower rim 31. As such, it will be appreciated that the exemplary setup illustrated schematically in FIG. 10 is effectively a representation of the alternative embodiment of FIGS. 8 and 9 wherein a central, shared set of grooved bearing lugs 60 and a single cable tension dial assembly 70 are employed in the drum tuning rim apparatus 20, though again those skilled in the art will appreciate that a variety of alternative arrangements of the hardware and thus of the electronic control and resulting system beyond that illustrated in FIG. 10 are possible, such that it will be appreciated that the schematic is merely illustrative of aspects of the invention and non-limiting. It is further noted that while the upper and lower or first and second rims 30, 31, are shown in FIG. 10 as being part of the drum tuning rim apparatus 20, it will be appreciated that the rims may be standard rims or otherwise separate from the apparatus 20, as when the housing assemblies 40 are removably engaged with each rim. The microprocessor 71 is shown as having RAM and ROM memory and is generally configured with the appropriate circuitry and firmware to enable communication and control in a manner generally now known or later developed in the art. At the very least, the apparatus microprocessor 71 would include in its ROM memory software or firmware configured to enable the operation of the processor and the overall apparatus, whereas the RAM memory would include all other data obtained by or sent to the processor 71, such as feedback data from the motor 85 or an external sensor 94 as might measure tension in a cable 90 or stress or pitch of the drumhead 14 or data such as control commands relayed through the apparatus interface 73. The apparatus interface 73 itself may be in wired or wireless communication with an apparatus controller 92. In one exemplary embodiment, as mentioned above, the apparatus controller 92 may be software running on a computing device such as a smartphone, tablet device, computer, or other such device now known or later developed and configured to communicate with the processor 71 through the interface 73, again via a wired or wireless connection. Instead or in addition, the apparatus 20 may be configured with a controller 92 directly on the apparatus, such as a control panel, selection buttons, touchpad, touchscreen interface, or other such input means for user control of the apparatus 20. Finally, the cable tension dial assembly 70 may be equipped with an on-board apparatus power supply/regulator 87 for taking power from an external power source P such as an A/C source, and thereby operably powering the microprocessor 71, the motor 85, and any other components of the system, directly or indirectly. As will be appreciated, the connection to the external power source P may be constant, as by plugging the apparatus 20 into such a power source (e.g., an outlet), or may be temporary, as by plugging the apparatus 20 in just long enough to charge the on-board power supply/regulator 87 (e.g., a rechargeable battery). It will be appreciated that any means of powering the system now known or later developed is possible in the present invention without departing from its spirit and scope, such that those power components shown and described are to be understood as merely illustrative and non-limiting. More generally, those skilled in the art will appreciate that aspects of such a system and method can be achieved by a variety of means that include but are not limited to the use of an electric motor 85, attached internally or externally to the cable tension dial assembly 70. Any such motor 85 would effectively be attached to the dial itself and would be capable of increasing or decreasing tension on the drumhead 14 by means of turning the dial one direction or the other. The motor 85 would be either self-monitoring and auto-adjusting as under the control of the microprocessor 71, or it would be manually adjusted, as by selectively operating a button, lever, switch, dial or knob, etc. remotely or directly on the unit. This motor 85 could be triggered by some form of sensor 94, either internal or external, such as being integral to the motor, the dial, or the drumhead, or externally mounted to the drum in any conceivable configuration. In one exemplary embodiment, the sensor 94 would be able to read and determine the overall tension of the drumhead 14 by reading the frequency of vibration that is produced when the head is struck, by reading the surface tension on the head when it is at rest, by acoustically identifying the tone, by sensing the tension of the cable on the dial, or by any other such means now known or later developed. By way of further example, the sensor 94 could be an audio sensor/microphone, a laser or infrared sensor, a pressure sensor, or any other sensor used to determine tone, surface tension, cable tension, etc., again, whether now known or later developed and however appropriate mounted on the drum or otherwise operably installed. Any such information obtained from any such sensor 94 would be relayed back to the motor 85 inside the dial assembly 70 as through the microprocessor 71, again via a wired or wireless connection as represented by the dashed line, and the motor 85 will adjust the head tension accordingly until the desired tension is attained on the drumhead 14, or until the drum produces the desired pitch and tone when struck. The motor 85, attached to the dial assembly 70 or otherwise integral to the apparatus 20 itself, may have a digital interface, whether a touch screen, a manually adjustable control, a simple "preset" button, or some other means by which a specific tension, tone, or frequency, as determined by the user and detected by the sensor 94, is saved into the system and repeated instantly with the "touch of a button." This "button" or "user interface" could be integral to the apparatus 20 itself, or it could be externally connected, for example, wirelessly connected to the apparatus 20 as or via a pedal (like a guitar pedal), a drum pad, a smart phone, tablet, computer, or some other external system or device through which the pre-saved settings can be accessed, any such user interface or input being collectively and generally represented as the apparatus controller 92 of FIG. 10. This way a drummer would have the means of instantly and accurately switching between preset tuning options on his or her acoustic drum or drum set without the need to manually tune or adjust the drum(s) in any way, more about which is said below concerning use of such a system. It is further noted in the context of electronic or electro-mechanical control of an acoustic drum or drum set according to aspects of the present invention that a further exemplary, non-limiting approach beyond the exemplary apparatuses 20 shown and described herein would be include a drum hoop that is magnetically attached to the drum rim. Through the use of an electromagnetic current, the strength of the magnetism between the two hoops could be adjusted to produce varying tension in the drumhead. The use of an electronic and/or manually adjustable interface to control the electromagnetic current could produce the same level of control and automatic-tuning capabilities as mentioned above. Another conceivable exemplary method for producing the same results would be to use a type of skin material in the drumhead itself that responds to electromagnetic current, such that depending on the voltage that is applied to the drum skin itself, the drumhead would respond with different levels of rigidity and vibrate at different frequencies accordingly. As such, those skilled in the art will appreciate that modifications to the hardware components of the system and related methods of use are also possible according to aspects of the present invention in order to render the resulting system operable in particular contexts or alternative configurations without departing from the spirit and scope of the present invention. More generally, any mechanical, electronic, electro-mechanical, electro-magnetic, materials, or other such method of selectively adjusting tension in a cable or a drumhead itself, whether now known or later developed, may be employed in an apparatus or system according to aspects of the present invention without departing from its spirit and scope.

Turning to FIG. 11, also in schematic block diagram format, there is depicted the idea of a system 110 whereby electro-mechanical control of each drum 10, 10', 10" in a kit is tuned via a central system controller 120, generally in keeping with the other aspects of the present invention as set forth herein. Each drum 10, 10', 10", numbered 1 to n+1, signifying essentially any number of drums, is operably configured or paired with its respective drum tuning rim apparatus 20, 20', 20", mechanically or otherwise, and its related sensor 94, 94', 94", again connected wired or wirelessly. Similarly, each drum tuning rim apparatus 20, 20', 20" is wired or wirelessly connected to its respective apparatus controller 92, 92', 92" as above-described in connection with FIG. 10, with each such drum tuning rim apparatus 20, 20', 20" and/or apparatus controller 92, 92', 92", in turn being wired or wirelessly connected to the system controller 120. In that regard, it will be appreciated by those skilled in the art that in certain contexts and configurations the central system controller 92 may interface with and directly control each drum tuning rim apparatus 20, 20', 20", may interface with and directly control each apparatus controller 92, 92', 92", or both. In other contexts of exemplary systems according to aspects of the present invention, there may not even be individual apparatus controllers 92, 92', 92", the central system controller 120 being the means by which all control is accomplished. In any such embodiment, the system controller 120, like any individual apparatus controller 92, may be a dedicated hardware device incorporated into or otherwise operably installed within the system 110 or may be a computing device such as a smartphone, tablet, or computer running software configured to enable the interface between the system controller 120 and one or more of the drum tuning rim apparatuses 20, 20', 20" and/or apparatus controllers 92, 92', 92". Optionally, then, any external user interface I through which a user may interact with the system controller 120 through the system interface 132 may also be a computing device, as might be the case where the system controller 120 is a dedicated device as a control panel or touchscreen interface, which may thus be operated directly on site or remotely via a secondary or external user interface I. With continued reference to FIG. 11, the system controller 120 is shown as comprising a system microprocessor 122 that again includes a RAM memory 124 and a ROM memory 128. The RAM memory 124 stores any particular operating protocol 126 selectively loaded in the processor 122 for operating the drum tuning rim system 110, such as different versions having different degrees of functionality and options (e.g., beginner versus professional systems with various programming capabilities, number of preset or stored tuning configurations possible, etc.). And as above for the individual apparatus controller 92, the RAM memory 124 may also store data sent to or received by the processor 122 both from the individual apparatuses 20, 20', 20" and/or apparatus controllers 92, 92', 92" and the related sensors 94, 94', 94" and from any user interface I selections as transmitted to the processor 122 through the system interface 132, whereby the processor 122 and hence the system controller 120 responds accordingly, at least in part, pursuant to the operating protocol 126 stored in RAM memory 124 of the processor 122. In alternative embodiments the operating protocol 126 may be stored in the ROM memory 128 of the processor 122, as when any such protocol is part of the firmware or basic operational software that is to be pre-installed and permanently reside in the processor 122.

Again, a system interface 132 is incorporated in the system 110 and in communication with the processor 122, which system interface 132 itself is in wired or wireless communication with a user interface I as above-described. Finally, analogous to the individual drum tuning rim apparatus 20 of FIG. 10 and the power requirements of the dial assembly 70 of the apparatus 20, the system controller 120 may also be equipped with a system power supply/regulator 130 that is itself selectively connected to an external power source P in any manner now known or later developed for powering the controller 120 and potentially any of the other components of the system 110. It will thus generally be understood and appreciated that aspects of the present invention are further directed to a drum tuning system 110 made up of a number (n+1) of drum tuning apparatuses 20 associated with an equal number of drums 10, optionally further including separate apparatus controllers 92 and sensors 94 for each drum and drum apparatus pair. Whatever the format or configuration of the overall system 110 and the related system and/or apparatus level controllers, it will be appreciated that in order to enable a drummer to customize his or her tunings for a variety of sounds and applications, the system preferably has a manually adjustable option, whether any such user interface is again accomplished via the system controller 120 or the individual apparatus controllers 92, 92', 92" and whether through dedicated hardware or the use or incorporation of a computing device running appropriate software; in some embodiments the individual apparatus controllers 92, 92', 92" are simply incorporated within the overall system controller 120 or the various controllers are one and the same. Accordingly, the drummer would adjust each drum manually to the desired setting, then have the ability to save that setting, whether for the individual drum and/or for the entire drum set. By going through the presets, the drummer would be able to adjust one drum individually and independently of the others (snare drum or kick drum, for example) or adjust the entire drum set in unison. For example, a drummer could have his set tuned to a low end, rock style tuning for one song, then click a button or make a selection on his preset device (user interface) and change the tuning of the entire set to a brighter, jazzier tuning for the next song in the set. The total adjustment would take seconds. Combining the herein described technology with wireless technology such as Bluetooth® or other wireless protocol now known or later developed allows for the use of smart phone or computer applications that would advantageously communicate with the drum tuning rim system 110 according to aspects of the present invention. Any such software applications according to and consistent with aspects of the present invention could be used to create, save, and transfer drum tuning styles and settings between drummers and to upload them to the physical drum set by transferring the data wirelessly between the application and the physical tuning technology on the drum set. Drummers could search specific tuning settings for their specific drum set size and specifications as posted by other users, including professional drummers, and instantly duplicate that tuning on their own drum set. For example, if a drummer desired to play a specific song by a specific artist, he or she could look up specific tunings that other drummers have used for that song, depending on the particular type and dimensions of the drum set that they are using. They could then upload those settings to their set and save them in their preset mode. They could do this for each song in the set, quickly and easily selecting or toggling between tunings for each song that they play. Thus, the system and method according to aspects of the present invention allows for customization and convenience similar to an electric drum set but with the full-bodied projection, warmth, and playability of an acoustic drum set, thereby in essence having the "best of both worlds." It will again be appreciated by those skilled in the art that other embodiments and variations according to aspects of the present invention are possible without departing from its spirit and scope.

Aspects of the present specification may also be described as follows:

1. A drumhead tuning rim system for securing and tuning a drumhead on a drum shell of a drum, comprising a drumhead tuning rim apparatus comprising a cable tension dial assembly configured for operably engaging a rim of the drum so as to increase or decrease tension on the rim, the rim being configured for seating over the drumhead on the drum shell, and an apparatus controller configured for operably interfacing with the drumhead tuning rim apparatus so as to selectively control the cable tension dial assembly and thereby adjust the overall pitch of the drumhead as by adjusting the tension on the rim.

2. The system of embodiment 1 wherein the drumhead tuning rim apparatus further comprises a plurality of low friction housing assemblies configured to be installed spaced along the rim of the drum, a plurality of low friction lug assemblies configured to be installed spaced about the drum shell substantially between the respective housing assemblies, and a tensioning cable configured for alternately passing between and about respective housing and lug assemblies substantially about the perimeter of the drum shell and for operably engaging the cable tension dial assembly at opposite ends.

3. The system of embodiment 2 wherein a single row of lug assemblies are positioned about the drum shell, a single cable tension dial assembly is operably installed on the drum shell, and first and second tensioning cables are both operably engaged with the single cable tension dial assembly and with respective first and second rims each having respective housing assemblies installed thereon, whereby the single cable tension dial assembly is capable of adjusting the overall pitch of two drumheads.

4. The system of embodiment 3 wherein each lug assembly is formed having opposing grooves in which the respective first and second tensioning cables run.

5. The system of embodiment 2 wherein the housing assemblies comprise low friction bearing surfaces on which the tensioning cable runs.

6. The system of embodiment 2 wherein the housing assemblies comprise rotatable housing grooved bearing wheels on which the tensioning cable runs.

7. The system of embodiment 2 wherein the apparatus controller is selected from the group consisting of a dial and a key.

8. The system of embodiment 7 wherein the cable tension dial assembly further comprises a cable tension dial body installed on the drum shell, a shaft operable within the cable tension dial body and configured for engagement with the tensioning cable, and the dial selectively installed on the shaft for operation thereof, whereby rotation of the shaft as through operation of the dial effectively increases or decreases tension in the tensioning cable and thus raises or lowers the overall pitch of the drumhead.

9. The system of embodiment 7 wherein the cable tension dial assembly further comprises a cable tension dial body installed on the drum shell, a shaft operable within the cable tension dial body and configured for engagement with the tensioning cable, the shaft being formed with an outwardly protruding dial lug accessible through an opening formed in the dial body, and the key selectively engageable with the shaft via the dial lug for operation thereof, whereby rotation of the shaft as through operation of the key effectively increases or decreases tension in the tensioning cable and thus raises or lowers the overall pitch of the drumhead.

10. The system of embodiment 1 wherein the cable tension dial assembly further comprises a shaft and a tensioning cable operably engaging the shaft at opposite ends and mechanically coupled to the rim of the drum.

11. The system of embodiment 10 wherein the shaft is driven by a motor operably installed within the cable tension dial assembly.

12. The system of embodiment 11 further comprising an apparatus microprocessor operably engaged with the motor so as to selectively control operation thereof and thus of the shaft and tuning of the drumhead.

13. The system of embodiment 12 wherein the cable tension dial assembly further comprises an apparatus interface for selectively providing an operable interface between the apparatus microprocessor and the apparatus controller.

14. The system of embodiment 13 wherein the apparatus controller is selected from the group consisting of a control panel, a selection button, a touchpad, a touchscreen interface, a lever, a switch, a knob, a smartphone, a tablet device, and a computer.

15. The system of embodiment 13 wherein there is a wired connection between the apparatus controller and the apparatus microprocessor through the apparatus interface.

16. The system of embodiment 13 wherein there is a wireless connection between the apparatus controller and the apparatus microprocessor through the apparatus interface.

17. The system of embodiment 12 further comprising a sensor operably installed relative to the drum and operably engaged with the apparatus microprocessor so as to provide feedback to the cable tension dial assembly for adjustment of the pitch of the drumhead as desired.

18. The system of embodiment 1 further comprising a plurality of drumhead tuning rim apparatuses configured for operable engagement with a corresponding plurality of drums, a plurality of apparatus controllers operably interfacing with the plurality of drumhead tuning rim apparatuses, and a system controller having a system microprocessor operably engaged with the plurality of drumhead tuning rim apparatuses for selective control of one or more of the plurality of drumhead tuning rim apparatuses and thus selective tuning of one or more drums.

19. The system of embodiment 18 wherein the system controller directly controls the plurality of drumhead tuning rim apparatuses, such that the plurality of apparatus controllers are effectively incorporated within the system controller.

20. The system of embodiment 18 wherein the system microprocessor comprises a RAM memory storing an operating protocol.

21. The system of embodiment 18 wherein the system controller is selected from the group consisting of a control panel, a selection button, a touchpad, a touchscreen interface, a lever, a switch, a knob, a smartphone, a tablet device, and a computer.

22. The system of embodiment 18 further comprising a system interface for selective interaction with the system controller.

23. The system of embodiment 18 further comprising a plurality of sensors operably installed relative to the plurality of drums and operably engaged with the system microprocessor so as to provide feedback to the plurality of drumhead tuning rim apparatuses for adjustment of the pitch of the respective drums as desired.

24. A drumhead tuning rim system for securing and tuning a drumhead on a drum shell of a drum, comprising a drumhead tuning rim apparatus comprising a cable tension dial assembly operably engaging a rim of the drum so as to increase or decrease tension on the rim, the rim being configured for seating over the drumhead on the drum shell, the cable tension dial assembly comprising a shaft driven by a motor and mechanically engaged with the rim through a tensioning cable, and an apparatus controller operably interfacing with the drumhead tuning rim apparatus so as to selectively control the cable tension dial assembly and thereby adjust the overall pitch of the drumhead as by adjusting the tension on the rim, the apparatus controller being selected from the group consisting of a control panel, a selection button, a touchpad, a touchscreen interface, a lever, a switch, a knob, a smartphone, a tablet device, and a computer.

25. A method of securing and tuning a drumhead on a drum shell of a drum, comprising the steps of positioning the drumhead on the drum shell, positioning a rim over the drumhead, the rim being configured with a plurality of housing assemblies installed thereabout, looping a tensioning cable passing around the housing assemblies underneath corresponding lug assemblies installed about the drum shell substantially between the respective housing assemblies, and tightening the tensioning cable until the desired overall pitch of the drumhead is achieved.

26. The method of embodiment 25 wherein the step of tightening the tensioning cable comprises selectively turning a dial of a cable tension dial assembly operably engaging the rim of the drum through the tensioning cable.

27. The method of embodiment 25 wherein the step of tightening the tensioning cable comprises engaging a key with a cable tension dial assembly operably engaging the rim of the drum through the tensioning cable, and selectively turning the key.

28. The method of embodiment 25 wherein the step of tightening the tensioning cable comprises selectively operating a motor operably engaged with a cable tension dial assembly operably engaging the rim of the drum through the tensioning cable.

29. The method of embodiment 28 wherein the step of selectively operating the motor comprises interacting with the motor through one of a control panel, a selection button, a touchpad, a touchscreen interface, a lever, a switch, a knob, a smartphone, a tablet device, and a computer.

30. The method of embodiment 25 wherein multiple drums are to be tuned, comprising the further steps of positioning a plurality of drumheads on a plurality of drum shells, positioning a plurality of rims over the respective drumheads, the rims each being configured with a plurality of housing assemblies installed thereabout, on each drum looping a tensioning cable passing around the housing assemblies underneath corresponding lug assemblies installed about the respective drum shells substantially between the respective housing assemblies, and selectively operating a system controller to selectively tighten one or more of the tensioning cables until the desired overall pitch of one or more of the drumheads is achieved.

To summarize, regarding the exemplary embodiments of the present invention as shown and described herein, it will be appreciated that a drumhead tuning rim system and method is disclosed and configured for drumhead mounting and tuning to replace the standard six, eight, or twelve lug and tension rod system that is currently used on most traditional drum kit snares, toms, and bass drums. Because the principles of the invention may be practiced in a number of configurations beyond those shown and described, it is to be understood that the invention is not in any way limited by the exemplary embodiments, but is generally directed to a drumhead tuning rim system and method and is able to take numerous forms to do so without departing from the spirit and scope of the invention. Furthermore, the various features of each of the above-described embodiments may be combined in any logical manner and are intended to be included within the scope of the present invention.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the present invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

Specific embodiments disclosed herein may be further limited in the claims using "consisting of" or "consisting essentially of" language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the present invention so claimed are inherently or expressly described and enabled herein.

It should be understood that the logic code, programs, modules, processes, methods, and the order in which the respective elements of each method are performed are purely exemplary. Depending on the implementation, they may be performed in any order or in parallel, unless indicated otherwise in the present disclosure. Further, the logic code is not related, or limited to any particular programming language, and may comprise one or more modules that execute on one or more processors in a distributed, non-distributed, or multiprocessing environment.

The methods as described above may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multi-chip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A drumhead tuning rim system for securing and tuning a drumhead on a drum shell of a drum, comprising:

a drumhead tuning rim apparatus comprising a cable tension dial assembly configured for operably engaging a rim of the drum so as to increase or decrease tension on the rim and further comprising a plurality of low friction lug assemblies configured to be installed spaced about the drum shell, the rim being configured for seating over the drumhead on the drum shell, wherein the cable tension dial assembly further comprises a shaft and a tensioning cable operably engaging the shaft and the lug assemblies and mechanically coupled to the rim of the drum; and an apparatus controller configured for operably interfacing with the drumhead tuning rim apparatus so as to selectively control the cable tension dial assembly and thereby adjust the overall pitch of the drumhead as by adjusting the tension on the rim.

2. The system of claim 1 wherein the drumhead tuning rim apparatus further comprises:

a plurality of low friction housing assemblies configured to be installed spaced along the rim of the drum; wherein the plurality of low friction lug assemblies are configured to be installed spaced about the drum shell substantially between the respective housing assemblies; and wherein the tensioning cable is configured for alternately passing between and about respective housing and lug assemblies substantially about the perimeter of the drum shell.

3. The system of claim 2 wherein:

a single row of lug assemblies are positioned about the drum shell;

a single cable tension dial assembly is operably installed on the drum shell; and first and second tensioning cables are both operably engaged with the single cable tension dial assembly and with respective first and second rims each having respective housing assemblies installed thereon, whereby the single cable tension dial assembly is capable of adjusting the overall pitch of two drumheads.

4. The system of claim 3 wherein each lug assembly is formed having opposing grooves in which the respective first and second tensioning cables run.

5. The system of claim 2 wherein the housing assemblies comprise low friction bearing surfaces on which the tensioning cable runs.

6. The system of claim 2 wherein the housing assemblies comprise rotatable housing grooved bearing wheels on which the tensioning cable runs.

7. The system of claim 2 wherein the apparatus controller is selected from the group consisting of a dial and a key.

8. The system of claim 7 wherein the cable tension dial assembly further comprises:

a cable tension dial body installed on the drum shell;

a shaft operable within the cable tension dial body and configured for engagement with the tensioning cable; and the dial selectively installed on the shaft for operation thereof, whereby rotation of the shaft as through operation of the dial effectively increases or decreases tension in the tensioning cable and thus raises or lowers the overall pitch of the drumhead.

9. The system of claim 7 wherein the cable tension dial assembly further comprises:

a cable tension dial body installed on the drum shell;

a shaft operable within the cable tension dial body and configured for engagement with the tensioning cable, the shaft being formed with an outwardly protruding dial lug accessible through an opening formed in the dial body; and the key selectively engageable with the shaft via the dial lug for operation thereof, whereby rotation of the shaft as through operation of the key effectively increases or decreases tension in the tensioning cable and thus raises or lowers the overall pitch of the drumhead.

10. The system of claim 1 wherein the shaft is driven by a motor operably installed within the cable tension dial assembly.

11. The system of claim 10 further comprising an apparatus microprocessor operably engaged with the motor so as to selectively control operation thereof and thus of the shaft and tuning of the drumhead.

12. The system of claim 11 wherein the cable tension dial assembly further comprises an apparatus interface for selectively providing an operable interface between the apparatus microprocessor and the apparatus controller.

13. The system of claim 12 wherein the apparatus controller is selected from the group consisting of a control panel, a selection button, a touchpad, a touchscreen interface, a lever, a switch, a knob, a smartphone, a tablet device, and a computer.

14. The system of claim 12 wherein there is a wired connection between the apparatus controller and the apparatus microprocessor through the apparatus interface.

15. The system of claim 12 wherein there is a wireless connection between the apparatus controller and the apparatus microprocessor through the apparatus interface.

16. The system of claim 11 further comprising a sensor operably installed relative to the drum and operably engaged with the apparatus microprocessor so as to provide feedback to the cable tension dial assembly for adjustment of the pitch of the drumhead as desired.

17. The system of claim 1 further comprising:

a plurality of drumhead tuning rim apparatuses configured for operable engagement with a corresponding plurality of drums;

a plurality of apparatus controllers operably interfacing with the plurality of drumhead tuning rim apparatuses; and a system controller having a system microprocessor operably engaged with the plurality of drumhead tuning rim apparatuses for selective control of one or more of the plurality of drumhead tuning rim apparatuses and thus selective tuning of one or more drums.

18. The system of claim 17 wherein the system controller directly controls the plurality of drumhead tuning rim apparatuses, such that the plurality of apparatus controllers are effectively incorporated within the system controller.

19. The system of claim 17 wherein the system microprocessor comprises a RAM memory storing an operating protocol.

20. The system of claim 17 wherein the system controller is selected from the group consisting of a control panel, a selection button, a touchpad, a touchscreen interface, a lever, a switch, a knob, a smartphone, a tablet device, and a computer.

21. The system of claim 17 further comprising a system interface for selective interaction with the system controller.

22. The system of claim 17 further comprising a plurality of sensors operably installed relative to the plurality of drums and operably engaged with the system microprocessor so as to provide feedback to the plurality of drumhead tuning rim apparatuses for adjustment of the pitch of the respective drums as desired.

23. A drumhead tuning rim system for securing and tuning a drumhead on a drum shell of a drum, comprising:

a drumhead tuning rim apparatus comprising a cable tension dial assembly operably engaging a rim of the drum so as to increase or decrease tension on the rim, the rim being configured for seating over the drumhead on the drum shell, the cable tension dial assembly comprising a shaft driven by a motor and mechanically engaged with the rim through a tensioning cable; and an apparatus controller operably interfacing with the drumhead tuning rim apparatus so as to selectively control the cable tension dial assembly and thereby adjust the overall pitch of the drumhead as by adjusting the tension on the rim, the apparatus controller being selected from the group consisting of a control panel, a selection button, a touchpad, a touchscreen interface, a lever, a switch, a knob, a smartphone, a tablet device, and a computer.

24. A method of securing and tuning a drumhead on a drum shell of a drum, comprising the steps of:

positioning the drumhead on the drum shell;

positioning a rim over the drumhead, the rim being configured with a plurality of housing assemblies installed thereabout;

looping a tensioning cable passing around the housing assemblies underneath corresponding lug assemblies installed about the drum shell substantially between the respective housing assemblies; and tightening the tensioning cable until the desired overall pitch of the drumhead is achieved.

25. The method of claim 24 wherein the step of tightening the tensioning cable comprises selectively turning a dial of a cable tension dial assembly operably engaging the rim of the drum through the tensioning cable.

26. The method of claim 24 wherein the step of tightening the tensioning cable comprises:

engaging a key with a cable tension dial assembly operably engaging the rim of the drum through the tensioning cable; and selectively turning the key.

27. The method of claim 24 wherein the step of tightening the tensioning cable comprises selectively operating a motor operably engaged with a cable tension dial assembly operably engaging the rim of the drum through the tensioning cable.

28. The method of claim 27 wherein the step of selectively operating the motor comprises interacting with the motor through one of a control panel, a selection button, a touchpad, a touchscreen interface, a lever, a switch, a knob, a smartphone, a tablet device, and a computer.

29. The method of claim 24 wherein multiple drums are to be tuned, comprising the further steps of:

positioning a plurality of drumheads on a plurality of drum shells;

positioning a plurality of rims over the respective drumheads, the rims each being configured with a plurality of housing assemblies installed thereabout;

on each drum looping a tensioning cable passing around the housing assemblies underneath corresponding lug assemblies installed about the respective drum shells substantially between the respective housing assemblies; and selectively operating a system controller to selectively tighten one or more of the tensioning cables until the desired overall pitch of one or more of the drumheads is achieved.

* * * * *